US011052289B2

(12) United States Patent
Cason

(10) Patent No.: US 11,052,289 B2
(45) Date of Patent: Jul. 6, 2021

(54) SWIM CAP FOR PERSONS WITH LONG HAIR

(71) Applicant: Michael Cason, Amityville, NY (US)

(72) Inventor: Michael Cason, Amityville, NY (US)

( * ) Notice: Subject to any disclaimer, the term of this patent is extended or adjusted under 35 U.S.C. 154(b) by 106 days.

(21) Appl. No.: 16/121,213

(22) Filed: Sep. 4, 2018

(65) Prior Publication Data

US 2018/0369646 A1 Dec. 27, 2018

Related U.S. Application Data

(62) Division of application No. 14/604,687, filed on Jan. 24, 2015, now Pat. No. 10,099,088.

(Continued)

(51) Int. Cl.
*A63B 33/00* (2006.01)
*A42B 1/12* (2006.01)

(Continued)

(52) U.S. Cl.
CPC ..... *A63B 33/00* (2013.01); *A42B 1/12* (2013.01); *A42B 1/203* (2013.01); *A42B 1/24* (2013.01);

(Continued)

(58) Field of Classification Search
CPC ..... A63B 33/00; A63B 2207/02; A63B 2225/685; A42B 1/12; A42B 1/203; A42B 1/24; A42B 1/244

(Continued)

(56) References Cited

U.S. PATENT DOCUMENTS 1,501,409 A 7/1924 Logan ..... 2/68
D118,808 S 1/1940 Solash ..... D2/881

(Continued)

FOREIGN PATENT DOCUMENTS

CN 201213998 4/2009 ..... A63B 33/00

OTHER PUBLICATIONS

Notification of Transmittal of the International Search Report and the Written Opinion of the International Searching Authority, or the Declaration, dated Apr. 14, 2015, which was issued by the International Searching Authority of WIPO in Applicant's corresponding international PCT application having Serial No. PCT/US2015/012794, filed on Jan. 24, 2015.

(Continued)

*Primary Examiner* — Alissa L Hoey
(74) *Attorney, Agent, or Firm* — Bodner & O'Rourke, LLP; Gerald T. Bodner; Christian P. Bodner

(57) ABSTRACT

A swim cap for persons having long hair includes a shell preferably having at least two interconnected compartments for receiving and encapsulating the hair of a user. The swim cap is secured around the head of a user by at least one draw string or adjustable band positioned within a channel near the open end of the swim cap as well as a chin strap extending downwardly from the cap. The interconnected compartments can be inflated to provide buoyancy. The shell further includes an outer layer and an inner layer defining a space therebetween that can also be inflated, or comprised of buoyant material, to provide buoyancy. A pump, compressed air canister or manual filler tube in communication with the interconnected compartments or space within the shell can be used to provide inflation. A pair of ear flaps extends downwardly from the swim cap around a user's head.

11 Claims, 18 Drawing Sheets

Related U.S. Application Data

(60) Provisional application No. 61/931,263, filed on Jan. 24, 2014.

(51) Int. Cl.
*A42B 1/24* (2021.01)
*A42B 1/244* (2021.01)
*A42B 1/203* (2021.01)
*A63B 71/06* (2006.01)

(52) U.S. Cl.
CPC ..... *A42B 1/244* (2013.01); *A63B 71/0622* (2013.01); *A63B 2071/0625* (2013.01); *A63B 2225/09* (2013.01); *A63B 2225/62* (2013.01); *A63B 2225/685* (2013.01); *A63B 2225/74* (2020.08)

(58) Field of Classification Search
USPC ..... 2/68
See application file for complete search history.

(56) References Cited

U.S. PATENT DOCUMENTS 2,320,222 A * 5/1943 Crupi ..... A63B 33/00 362/106
3,403,406 A 10/1968 Weissberg ..... 2/68
D214,012 S * 5/1969 Russo ..... D29/103
3,755,819 A 9/1973 Douglas ..... 2/428
4,281,417 A 8/1981 Valentine ..... 2/68
D277,139 S 1/1985 DeFalco ..... D2/880
4,638,410 A * 1/1987 Barker ..... B63C 11/02 128/201.11
4,817,212 A * 4/1989 Benoit ..... A42B 1/12 2/68
D315,035 S 2/1991 Tucker ..... D28/12
5,099,865 A 3/1992 Flannery et al. ..... 132/212
5,243,707 A * 9/1993 Bodinet ..... A42B 1/004 2/200.1
5,349,702 A 9/1994 Runckel ..... 2/68
5,727,575 A 3/1998 Rontal ..... 132/200
5,878,756 A 3/1999 Bilodeau ..... 132/274
6,007,212 A * 12/1999 Chan ..... A42B 1/004 362/105
6,223,355 B1 * 5/2001 Irving ..... A42B 1/004 2/171
D482,843 S 12/2003 Burnett ..... D2/500
D513,661 S 1/2006 Handy ..... D2/881
7,096,510 B2 8/2006 Yeadon ..... 2/202
D572,879 S 7/2008 Marquardt ..... D2/867
7,412,729 B1 8/2008 McGovern ..... 2/174
7,677,940 B1 3/2010 Nazarian ..... 441/106
D624,284 S 9/2010 Creel ..... D2/867
7,793,371 B1 9/2010 Leach ..... 5/632
7,793,657 B1 9/2010 Sandusky ..... 128/201.11
8,032,950 B2 10/2011 Leftenant ..... 2/202
8,061,366 B2 11/2011 Britton et al. ..... 132/200
D712,636 S 9/2014 Whittington ..... D2/883
D726,396 S 4/2015 Cason et al. ..... D2/867
D727,604 S 4/2015 Padmore ..... D2/867
9,138,025 B1 9/2015 Lunsford
10,099,088 B2 * 10/2018 Cason ..... A63B 33/00
2003/0200594 A1 10/2003 McGreggor ..... 2/202
2003/0221243 A1 12/2003 Phillips ..... 2/202
2005/0066415 A1 3/2005 Adkins ..... 2/171
2006/0037607 A1 2/2006 Trujillo ..... 128/201.11
2006/0179544 A1 8/2006 Knievel ..... 2/181
2006/0198122 A1 * 9/2006 Senter ..... A42B 3/044 362/105
2006/0200889 A1 9/2006 Newman ..... 2/68
2006/0212994 A1 * 9/2006 Proctor ..... A42B 1/244 2/171
2006/0288467 A1 12/2006 Jones ..... 2/174
2008/0068556 A1 * 3/2008 Harrison ..... A63B 33/00 351/49
2008/0130269 A1 * 6/2008 Tseng ..... H05B 47/155 362/103
2009/0038048 A1 2/2009 Thompson ..... 2/68
2009/0151048 A1 6/2009 Laury ..... 2/202
2009/0241243 A1 * 10/2009 Ritter ..... A42B 1/244 2/209.13
2009/0293177 A1 12/2009 Adkins ..... 2/171
2010/0064418 A1 3/2010 Graham ..... 2/206
2010/0095431 A1 * 4/2010 Liao ..... A42B 1/244 2/209.13
2010/0192282 A1 8/2010 Matthews ..... 2/174
2010/0242980 A1 9/2010 D'Assis et al. ..... 132/200
2010/0275946 A1 11/2010 Ruschell ..... 132/210
2012/0023642 A1 2/2012 Holland ..... 2/207
2012/0079643 A1 4/2012 Clarke ..... 2/171
2013/0033852 A1 * 2/2013 Liao ..... A42B 1/24 362/106
2013/0174323 A1 * 7/2013 McFall ..... A42B 1/244 2/209.13
2013/0198935 A1 * 8/2013 Waters ..... A42C 5/00 2/209.13
2013/0242544 A1 * 9/2013 Liao ..... F21V 21/084 362/106
2013/0247269 A1 9/2013 Alburg ..... 2/68
2013/0276213 A1 10/2013 Olsson et al. ..... 2/413
2013/0340144 A1 * 12/2013 Strong ..... A41D 27/08 2/209.13
2014/0049947 A1 * 2/2014 Lombard ..... A41D 19/0157 362/106
2014/0053318 A1 * 2/2014 Fitzgerald ..... A42B 1/006 2/209.13
2014/0101821 A1 4/2014 Dammann et al. ..... 2/171.4
2014/0109281 A1 4/2014 Waller et al. ..... 2/68
2014/0270685 A1 * 9/2014 Letke ..... A42B 1/244 386/224
2014/0304891 A1 * 10/2014 Waters ..... A42B 1/24 2/209.13
2014/0347845 A1 * 11/2014 Pulido, Jr. ..... A41D 27/085 362/103
2015/0047101 A1 * 2/2015 Korioth ..... A42B 1/004 2/209.13
2015/0063777 A1 * 3/2015 Letke ..... A42B 1/244 386/224
2015/0289048 A1 * 10/2015 Schermerhorn ... A63B 71/0622 381/376
2015/0359284 A1 12/2015 Watson ..... 2/174
2016/0120254 A1 5/2016 Montoya et al. ..... 2/68
2016/0305645 A1 * 10/2016 Hall ..... A42B 1/244
2017/0237284 A1 * 8/2017 Summers ..... A42B 1/24 136/244

OTHER PUBLICATIONS

Written Opinion of the International Searching Authority, dated Apr. 14, 2015, which was issued by the International Searching Authority of WIPO in Applicant's corresponding international PCT application having Serial No. PCT/US2015/012794, filed on Jan. 24, 2015.
International Search Report, dated Apr. 14, 2015, which was issued by the International Searching Authority of WIPO in Applicant's corresponding international PCT application having Serial No. PCT/US2015/012794, filed on Jan. 24, 2015.

* cited by examiner

SWIM CAP FOR PERSONS WITH LONG HAIR

CROSS-REFERENCE TO RELATED APPLICATIONS

This application is a divisional of U.S. patent application Ser. No. 14/604,687, filed on Jan. 24, 2015, and entitled "Swim Cap For Persons With Long Hair", which claims the benefit of priority under 35 U.S.C. 119 and/or 35 U.S.C. 120 to U.S. Provisional Application Ser. No. 61/931,263, filed on Jan. 24, 2014, and entitled "Swim Cap For Persons With Long Hair", the disclosure of each of which is incorporated herein by reference and on which priority is hereby claimed.

BACKGROUND OF THE INVENTION

Field of the Invention

The present invention generally relates to swim caps, and more specifically relates to swim caps for persons with long hair or who fashion their hair in dreadlocks.

Description of the Prior Art

Swimming caps are often required to be worn in public pools for health reasons and to address other concerns. Long hair more frequently clogs pool and spa filters than short hair, and loose long hair in a pool is more noticeable and unappealing to other bathers. Hence, park and pool authorities often require bathers with long hair to wear swim caps.

Bathers also oftentimes prefer to wear swim caps to protect their hair from the effects of chlorine in the pool water or salt in the ocean or bay. Bathers also prefer to wear swim caps to keep their hair as dry as possible while swimming or enjoying aquatic activities.

One of the problems with conventional swim caps is that they tightly fit over a wearer's head and are uncomfortable to wear, especially for those who have long hair. Oftentimes, it is difficult, if not impossible, to fit a conventional, tightly-fitting swim cap over the head of a person who has long hair. Most swim caps are made from an elastic, rubberized material, but even with their elasticity, such swim caps do not comfortably permit their use on persons with long hair. Additionally, conventional, tightly-fitting swim caps often compress a user's hair therein, leaving the hair tangled and disheveled when the swim cap is removed.

Furthermore, the conventional, tightly-fitting swim caps are almost impossible to use by persons who have their hair fashioned in dreadlocks. Dreadlocks are a fashionable way of wearing one's hair in many different cultures and, because of the length of the hair and its arrangement in dreadlocks, conventional swim caps are not properly dimensioned to retain the dreadlocks within the confines of the swim cap.

OBJECTS AND SUMMARY OF THE INVENTION

It is an object of the present invention to provide a swim cap which may be worn by persons having long hair or dreadlocks.

It is another object of the present invention to provide a swim cap which is inflatable and which may provide buoyancy to the person wearing the swim cap.

It is a further object of the present invention to provide a swim cap which is useable by a person having long hair and which does not entangle or crush the hair of the person wearing the swim cap.

It is still another object of the present invention to provide a swim cap for a person having long hair which is structured to completely contain within the cap the person's hair.

It is still a further object of the present invention to provide a swim cap which overcomes the inherent disadvantages of conventional swim caps.

In accordance with one form of the present invention, a swim cap for use by a person having long hair, where such hair may be fashioned in dreadlocks, for example, includes an outer shell formed of a waterproof, latex or rubberized material. Preferably, the outer shell may be formed from two, or more preferably, three, interconnected compartments or sections which communicate with one another. The first compartment or section has an opening in which the user places his head. The opening is preferably dimensioned to tightly surround the wearer's head slightly in front of the hairline and covering the user's ears. The second and third interconnected compartments or sections are where the user's hair is primarily placed. The three compartments together define an elongated cavity to hold the user's long hair without significantly crushing or entangling the hair.

In another embodiment of the present invention, the outer shell of the swim cap of the present invention may be formed with an outer layer of latex or rubberized material, and an inner layer of similar material situated within the outer layer. The two layers are separated from each other to define an inflatable air chamber therebetween. This chamber may be filled with air to provide flotation not only for the compartments or sections of the swim cap but also for the wearer of the swim cap.

These and other objects, features and advantages of the present invention will be apparent from the following detailed description of illustrative embodiments thereof, which is to be read in connection with the accompanying drawings.

DETAILED DESCRIPTION OF THE PREFERRED EMBODIMENTS

Figure 1:
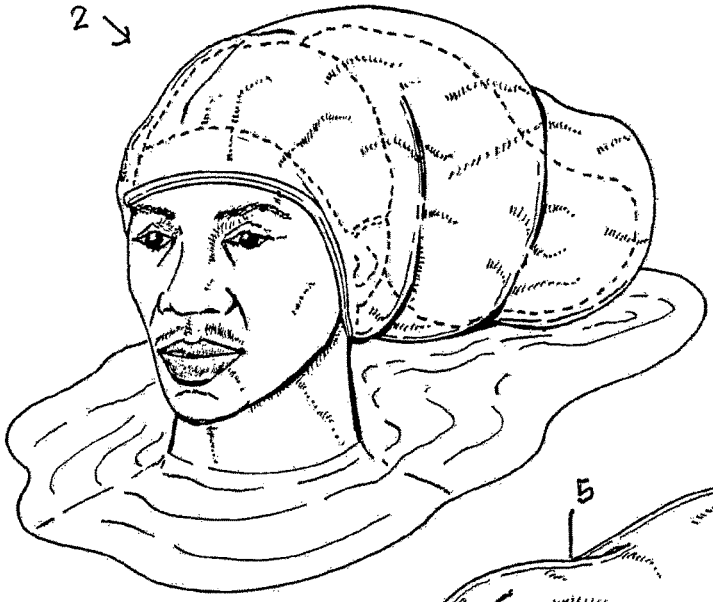
FIG. 1 is a perspective view of a swim cap constructed in accordance with one form of the present invention, shown being worn by a user.
Figure 2:
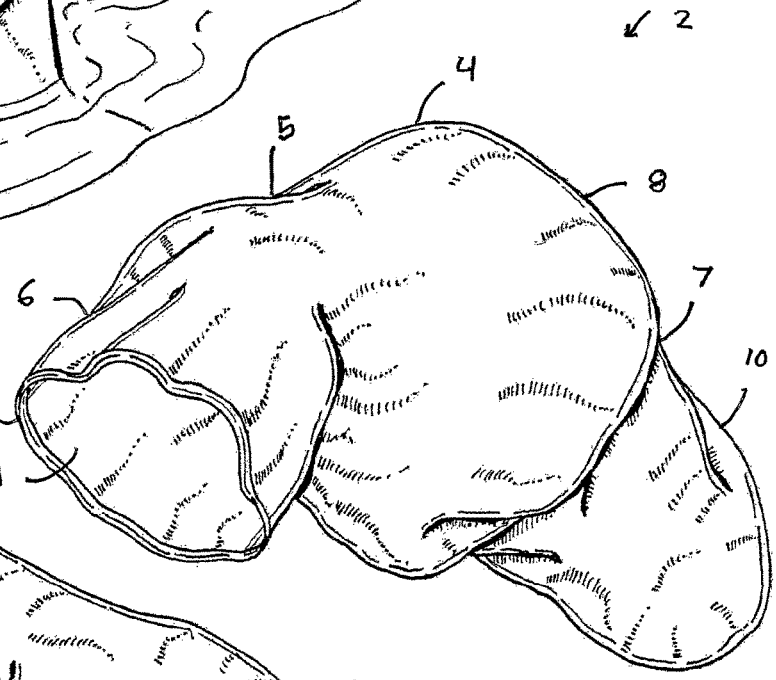
FIG. 2 is a front perspective view of the swim cap of the present invention shown in FIG. 1.
Figure 3:
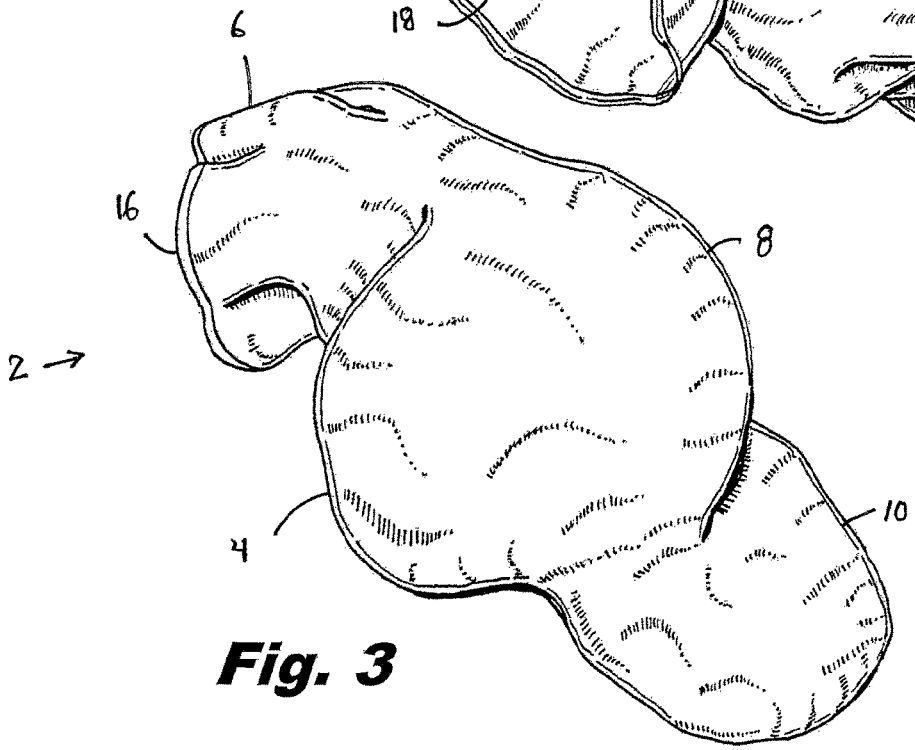
FIG. 3 is a rear perspective view of the swim cap of the present invention shown in FIGS. 1 and 2.

Referring initially to FIGS. 1-3 of the drawings, it will be seen that a swim cap 2 constructed in accordance with the present invention preferably includes a latex or rubberized outer shell 4 that is preferably contoured to form several interconnected sections or compartments. As is shown in FIGS. 1-3, preferably there are three compartments or sections defining the shell, that is, a first or front compartment or section 6 which may be fitted tightly over a portion of the user's head, a second or middle compartment or section 8 which is interconnected to the first or front compartment or section 6, and a third or rear compartment or section 10, which is interconnected to the second or middle compartment or section 8. The middle and end compartments 8, 10 are slightly bulbous in overall shape, as may also be the front compartment 6. Each of the compartments 6-10 is interconnected to the next adjacent compartment at a portion or section 5, 7 of the shell 4 having a diameter which is less than at least one of the two adjoining compartments 6, 8 or 8, 10 and together the three compartments or sections define a cavity 12 within the outer shell 4 to hold the long hair or dreadlocks 14 of a person wearing the swim cap 2 of the present invention. Preferably, the overall length of the swim cap 2 and outer shell 4, including each of the various compartments 6-10, is such that it can receive and retain within the cavity 12 defined thereby the long hair or dreadlocks 14 of a user, as shown in FIGS. 1-3, and also in FIGS. 4-6, preferably without entangling or crushing the hair of the user wearing the swim cap 2.

As can be seen in FIGS. 1-3, the front section 6 of the swim cap 2 of the present invention includes an elastic rim 16 that defines an open end 18 for placement of the swim cap on a portion of the user's head. Preferably, the dimensions of the rim 16 and preferably the elasticity thereof allow the first section 6 of the swim cap to be placed tightly over the forehead and the ears of the user so as to minimize any water leakage into the swim cap 2.

Figure 4:
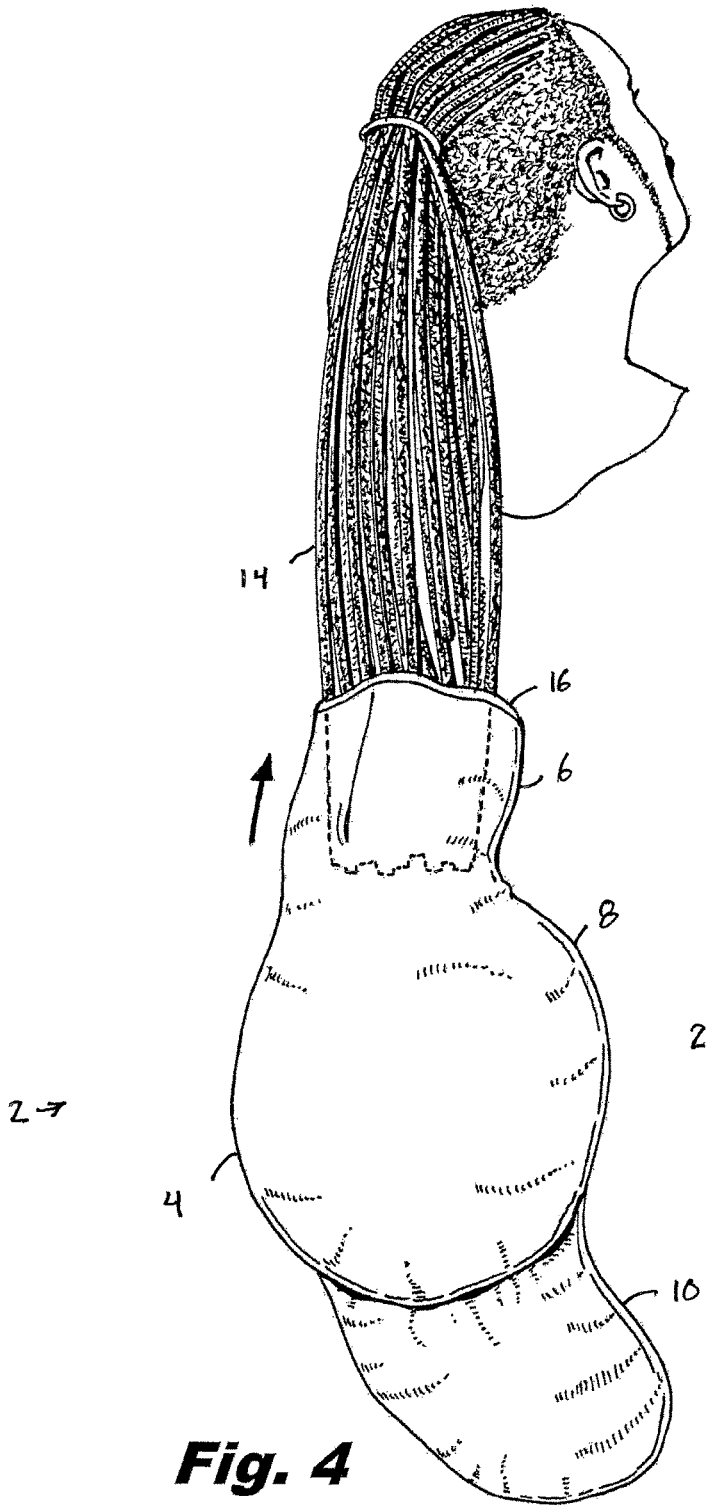
FIG. 4 is a perspective view, illustrating how the swim cap of the present invention may receive the long hair of a user.
Figure 5:
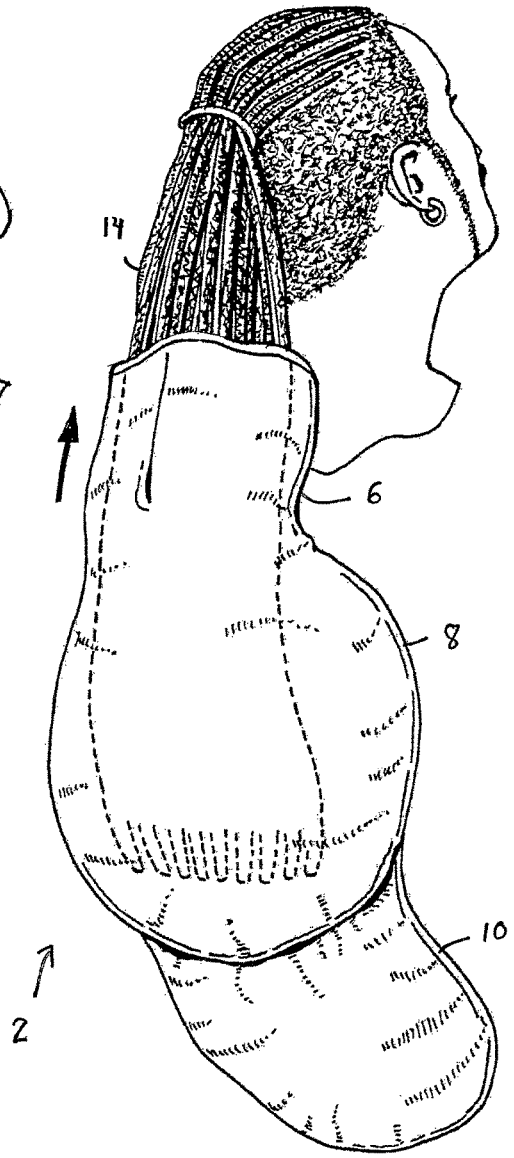
FIG. 5 is a perspective view of the swim cap of the present invention shown in FIG. 4, and further illustrates how the long hair of a user is received by the swim cap.
Figure 6:
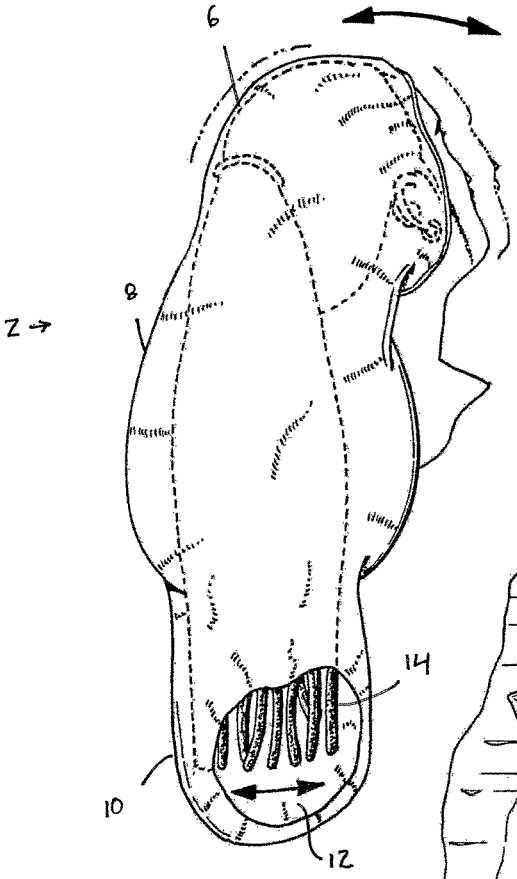
FIG. 6 is a perspective view of the swim cap of the present invention, partially broken away, illustrating how the swim cap receives the long hair of the user.

As can be seen in FIGS. 4-6 of the drawings, the user directs his long hair 14 to be placed through the opening 18 in the front section 6 of the swim cap (see FIG. 4) and moves the swim cap upwardly over the hair (see FIG. 5) until the swim cap 2 fully receives the long hair 14 of the user through the middle section 8 and into the end section 10 (see FIG. 6). The end section 10 is closed to the outside environment, and so is the middle section 8. Only the front or first section 6 of the swim cap has an opening 18 so that is may be placed on the user's head, as shown in FIG. 6.

As mentioned previously, and as can be seen in FIG. 6 of the drawings, the overall longitudinal length of the swim cap 2 of the present invention is preferably dimensioned to fully receive the long hair 14 of the user, and may provide additional space in the third section 10 thereof to accommodate various lengths of hair. Furthermore, since each compartment or section 6-10 is slightly bulbous in form, there is sufficient space in the cavity 12 of the swim cap defined by the various sections thereof for hair 14 of various thicknesses and widths, such as when the user's hair is fashioned in dreadlocks. Furthermore, as can be seen in FIG. 6, for longer than usual hair 14 that exceeds the length of the swim cap 2, the ends of the hair 14 may be curled slightly within the confines of the third section 10 of the swim cap, without entangling the hair or causing it to be crushed.

Figure 7:
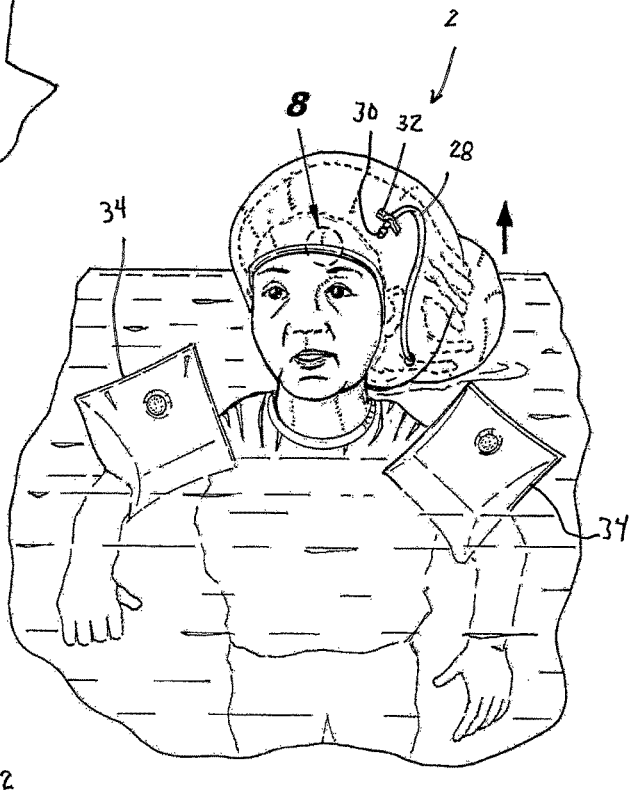
FIG. 7 is a perspective view of a second form of the swim cap constructed in accordance with the present invention, where the swim cap is inflatable.
Figure 8:
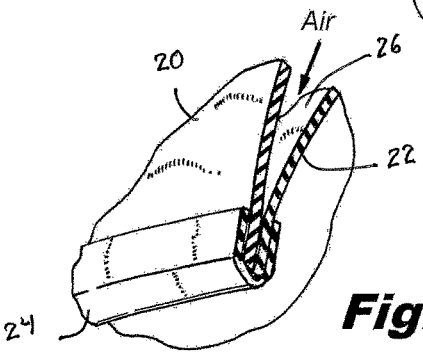
FIG. 8 is a partial perspective view showing in detail the rim of the swim cap of the present invention shown encircled by the broken line labeled with the reference number 8.
Figure 9:
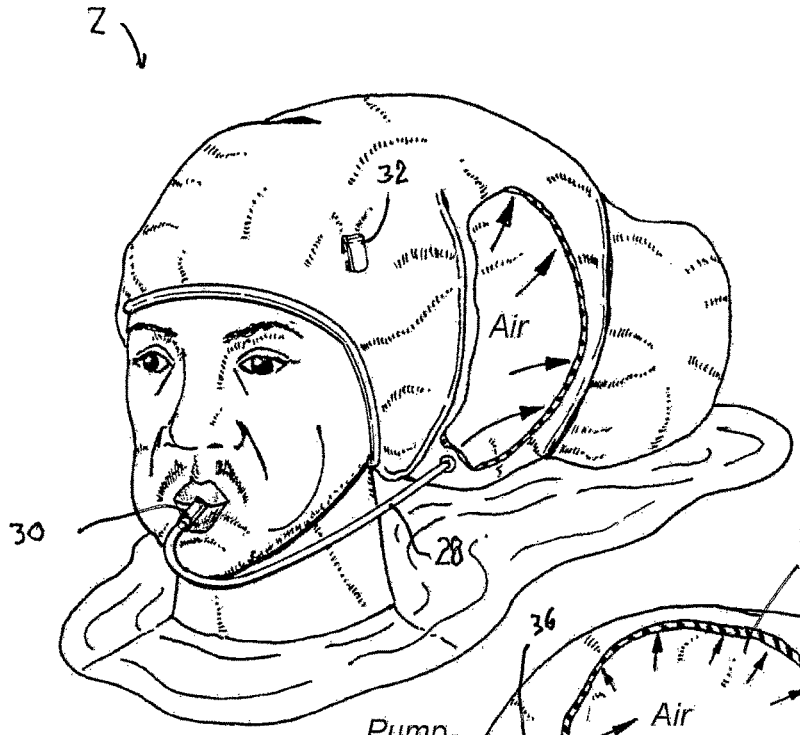
FIG. 9 is a perspective view of the swim cap of the present invention shown in FIG. 7, and illustrating how the swim cap may be inflated by a user.

FIGS. 7-9 illustrate another form of the swim cap 2 of the present invention. In this form, the swim cap is preferably inflatable to add buoyancy to the swim cap 2 and hair 14 received thereby, but may also provide additional buoyancy to the person using the swim cap. As can be seen from these figures, the outer shell 4 of the swim cap 2 is formed of two layers. More specifically, the shell 4 of the swim cap may include an outer layer 20 and an inner layer 22 situated adjacent to and within the outer layer 20. Each of the outer layer 20 and inner layer 22 may be formed from a latex or rubberized material. The ends of the outer and inner layers 20, 22 are joined together at the open end 18 or rim 16 of the first section of the swim cap by a U-shaped clip 24 defining the rim 16, which clip 16 may also be rubberized, or may be joined together by heat sealing the two ends together, or by adhesive or other means well known to one skilled in the art of joining two layers of latex or rubberized material together. Preferably, the outer and inner layer 20, 22 are joined together so as to form a substantially airtight chamber 26 therebetween, which chamber 26 may be inflated to provide buoyancy to the swim cap 2 and the wearer thereof. Alternatively, the inner cavity 12 defined by the shell 4 may serve as the air chamber 26.

As shown in FIGS. 7 and 9, this inflatable version of the swim cap 2 may include a hollow filler tube 28 having a valve 30 situated thereon preferably at an exposed axial end thereof, the filler tube 28 being removeably mounted on a resilient clip 32 or other attachment affixed to the outer layer 20 of the shell 4, and having an opposite axial end which is in fluid communication with either the air chamber 26 defined by the outer and inner layers 20, 22 of the shell, or with the inner cavity 12 in which the person's hair is received.

As shown in FIG. 9 of the drawings, a user may remove the exposed end of the tube 28 from the clip 32 and place the end in his mouth to blow air into the chamber 26 of the outer shell 4 of the swim cap (or into the inner hair cavity 12) to inflate the swim cap 2. Inflating the chamber 26 not only adds buoyancy or flotation to the swim cap, but also reduces the overall dimensions of the interior cavity 12 to hold the long hair 14 of the wearer in place within the swim cap. FIG. 7 shows a child wearing the inflatable swim cap 2 of the present invention, along with other inflatable devices 34 to provide buoyancy to the child, and FIG. 9 shows the inflatable swim cap 2 of the present invention being worn by an adult.

The valve 30 is preferably situated on the exposed end of the filler tube 28 of the swim cap. The valve 30 includes at least one flap internally of the valve which acts as a one-way valve under normal conditions. However, when the valve 30 is compressed or pinched, the flap opens to allow air within the chamber 26 or the inner hair cavity 12 of the swim cap 2 to escape therethrough in order to deflate the swim cap.

Figure 10:
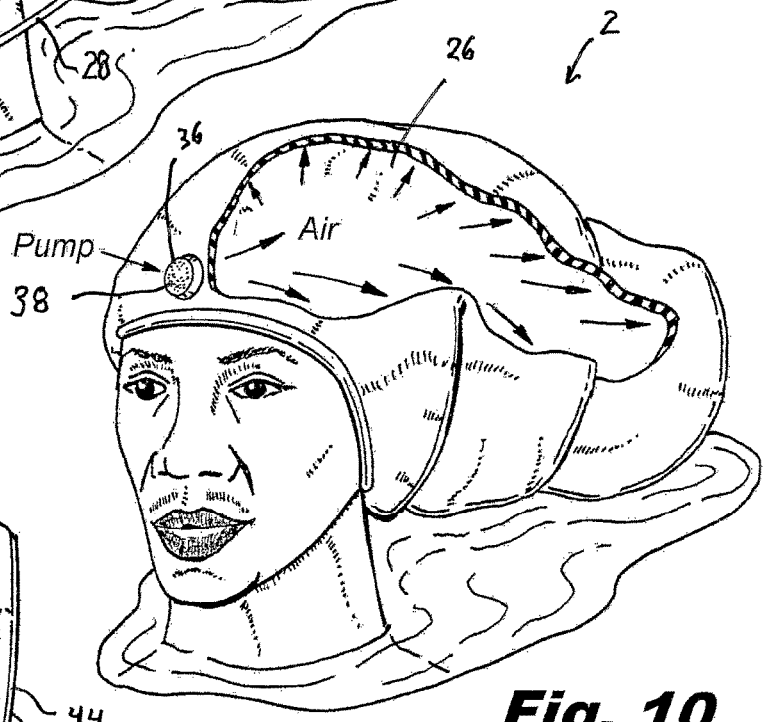
FIG. 10 is a perspective view of a swim cap formed in accordance with a third embodiment of the present invention, and illustrating how the swim cap may be inflated by a user.

FIG. 10 illustrates another form of an inflatable swim cap 2 formed in accordance with the present invention. Here, the swim cap 2 may have mounted on the outer layer 20 of the shell 4 a pump 36 formed as a compressible, rubberized projection 38 defining a small air chamber therein, such as in similar conventional air pumps well known in the art. The user presses on the projection 38 of the pump 36 with his finger, which forces air under the projection into the air chamber 26 of the swim cap to inflate the air chamber, or into the inner cavity 12 in which the person's hair is received to inflate the swim cap 2. Again, by pinching the pump projection 38, or by other means, air may be allowed to escape from the chamber 26 defined by the outer and inner layers 20, 22 of the swim cap shell 4 or from the inner hair cavity 12 to deflate the swim cap.

Figure 11:
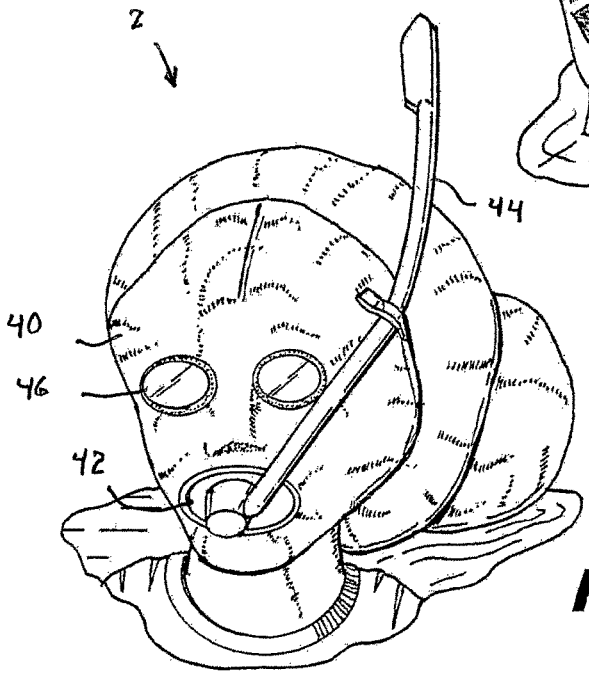
FIG. 11 is a perspective view of a fourth embodiment of the swim cap of the present invention, and illustrating how the swim cap may be used in conjunction with a swim face mask.

FIG. 11 illustrates another form of the swim cap 2 of the present invention. Here, the swim cap may mate with, or be attached to, a removeable swim mask 40. The periphery of the swim mask 40 is preferably elastic and tightly conforms to the shape of the user's face. The swim mask 40 also preferably forms a watertight seal with the rim 16 of the swim cap 2, and outer peripheral portions of the mask 40 are placed under the rim 16 of the swim cap. The mask 40 includes an opening 42 situated about the mouth of the user so that the user may breath through a snorkel 44 attached to the mask, and the mask 40 further includes a pair of transparent eye pieces 46 made of safety plastic or the like, or at least one large eye piece or lens, situated in alignment with the user's eyes so that the user may see through the swim mask 40.

FIGS. 12-15 illustrate yet another embodiment of the swim cap 2 of the present invention. In this embodiment, the swim cap is also inflatable, such as by using a tube 28 extending therefrom and having the structure of the inflatable swim cap shown in FIGS. 7-9 of the drawings. However, the swim cap of the present invention may also be joined to a pair of supplementary flotation or buoyancy devices 48, 50, as shown in FIGS. 12-15, so that, together, the swim cap 2 and the buoyancy devices 48, 50 act as a life preserver for the person, preferably a child, wearing the swim cap.

Figure 12:
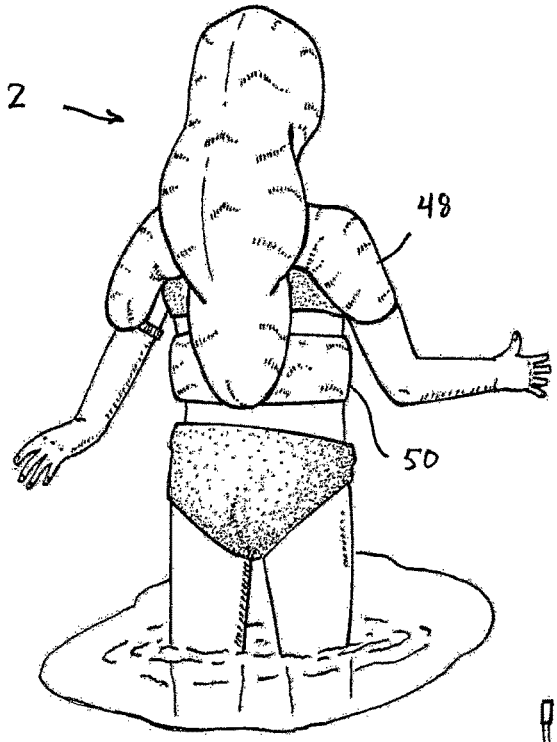
FIG. 12 is a perspective view of a swim cap formed in accordance with a fifth embodiment of the present invention, the fifth embodiment being one which may act as a life preserver for the wearer.
Figure 14:
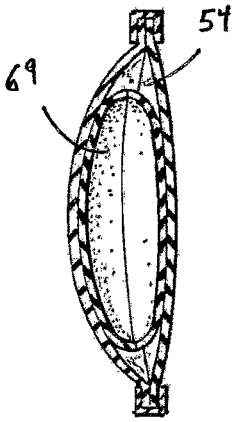
FIG. 14 is a cross-sectional view of the swim cap of the present invention shown in FIG. 13, taken along line 14-14 of FIG. 13.
Figure 15:
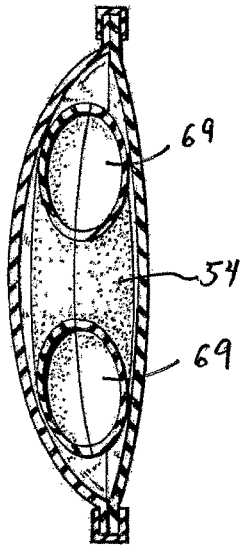
FIG. 15 is a cross-sectional view of the swim cap of the present invention shown in FIG. 13, taken along line 15-15 of FIG. 13.

More specifically, a first buoyancy device 48 formed as a flexible elongated member 52, which may include buoyant material 54, such as a closed cell foam sealed therein, is attached to the underside of the swim cap 2 at about the middle section 8 thereof. Thus, the elongated member 52 of the first buoyancy device 48 has an upper surface 21 and a lower surface 23 situated opposite the upper surface 21, a first lateral end portion 25 near one axial end thereof and a second lateral end portion 27 near the other opposite axial end thereof. The first buoyancy device 48 further includes a top surface 29, which is affixed to the outer shell 4 at an underside of the swim cap 2, and a bottom surface 31 situated opposite the top surface 29 which will be near the shoulders of a user of the swim cap 2 when the swim cap 2 is worn by the user. This first buoyancy device 48 includes pair of straps 56 near its opposite axial ends and extending perpendicularly from opposite lateral sides thereof. Each strap 56 includes a quick disconnect buckle having male and female mating connectors 58, 60. As shown in FIG. 12 of the drawings, the first buoyancy device 48 is draped over the back of the shoulders of the person, preferably a child, wearing the swim cap, with each quick disconnect strap 56 encircling a respective upper arm of the child wearing the swim cap.

The swim cap also includes a second buoyancy device 50. Like the first buoyancy device 48, the second buoyancy device 50 is formed of a flexible elongated member 62 also retaining in a preferably waterproof state buoyant material 54 therein, such as a closed cell foam, to provide buoyancy to the person wearing the swim cap. Thus, the elongated member 62 of the second buoyancy device 50 includes an upper surface 33 and a lower surface 35 situated opposite the upper surface 33, a first lateral end portion 37 near one axial end of the elongated member 62 and a second lateral end portion 39 near the opposite other axial end of the elongated member 62, and a top surface 41 which is affixed to the outer shell 4 at the underside of the swim cap 2 and a bottom surface 43 situated opposite the top surface 41 which will be in proximity to the back of the user of the swim cap 2 when the swim cap 2 is worn by the user. Extending outwardly from one axial end of the elongated member 62 of the second buoyancy device 50 is a male, quick disconnect connector 58 on the end of a strap 56, and extending outwardly from the opposite axial end of the elongated member 62 of the second buoyancy device 50 is a mating female, quick disconnect connector 60 on the end of another strap 56, each connector forming part of a buckle. The second buoyancy device 50 is preferably attached to the outer layer 20 of the shell 4 of the swim cap and situated in proximity to the end or third section 10 of the swim cap.

The second buoyancy device 50, like the first buoyancy device 48, is sufficiently flexible to fit about the waist or chest of the user, as shown in FIG. 12. The user wraps the second buoyancy device 50 about his or her chest or waist, and connects the male and female connector ends 58, 60 of the quick disconnect buckle together. Together, the inflatable swim cap 2, the first buoyancy device 48 attached thereto and the second buoyancy device 50 attached thereto, when worn by a user, provides additional buoyancy to the user and may act as a life preserver.

Figure 13:
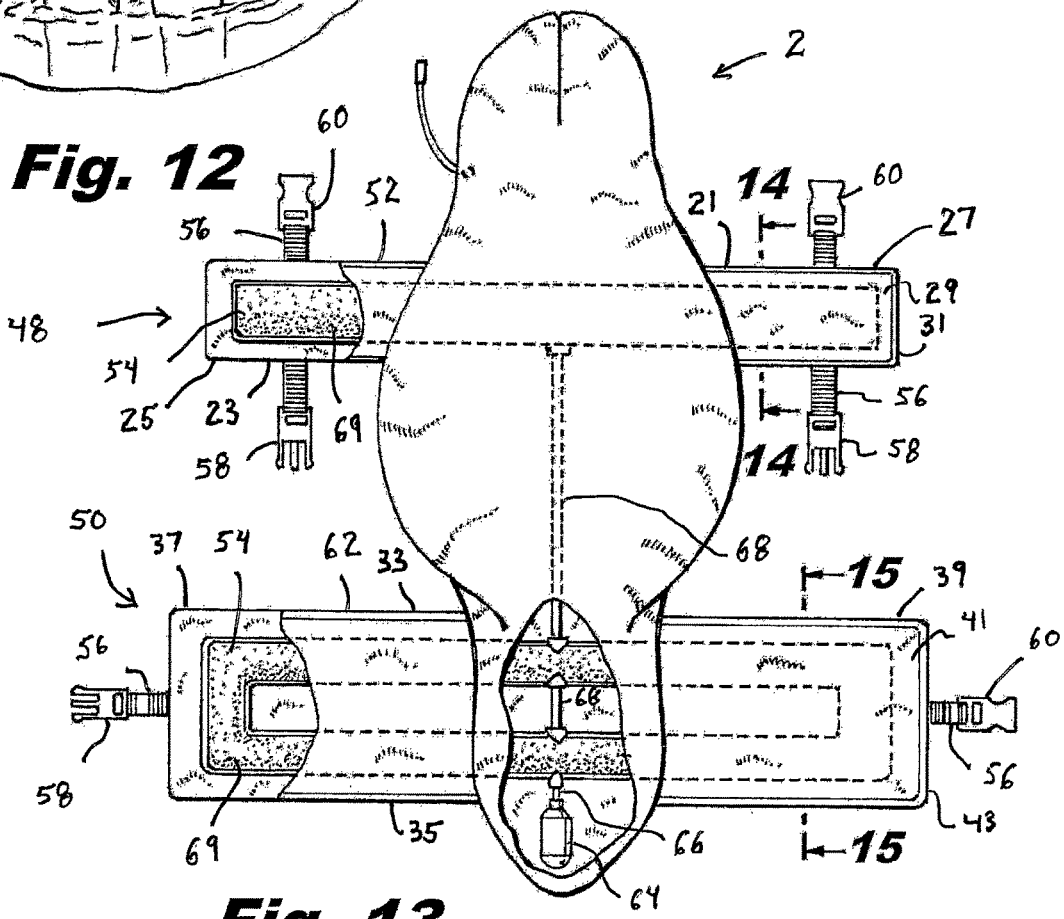
FIG. 13 is a perspective view of the fifth embodiment of the swim cap of the present invention shown in FIG. 12, prior to the swim cap being placed on a user.

Also shown in FIG. 13, in the broken away section thereof, is a canister 64, for use in an alternative embodiment of the present invention. This canister 64 contains compressed air and a needle end 66, and may be interconnected through appropriate tubing 68 to the interior of the first buoyancy device 48 and the second buoyancy device 50. In this alternative embodiment of the present invention, the closed cell foam or other flotation material 54 need not be included in the first buoyancy device 48 and the second buoyancy device 50, and each of the first and second buoyancy devices 48, 50 may define an inflatable bladder 69 therein. Alternatively, the first and second buoyancy devices 48, 50 may include both flotation material 54 and air bladders 69. The canister 64 may be used to inflate the air bladders 69 of the first and second buoyancy devices 48, 50, if such additional buoyancy is needed. The tube 68 interconnecting the compressed air canister 64 with the first buoyancy device 48 and with the second buoyancy device 50 preferably passes through the interior cavity 12 of the swim cap, and is in fluid communication with the bladders 69 of the first and second buoyancy devices 48, 50 at points where the buoyancy devices are attached to the outer layer 20 of the swim cap.

Figure 16:
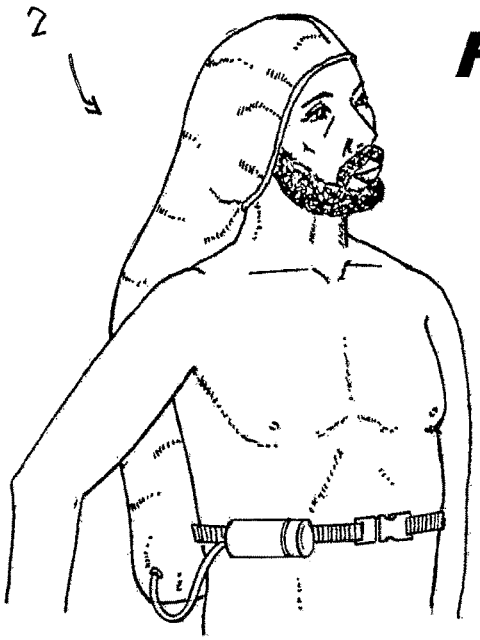
FIG. 16 is a perspective view of a swim cap formed in accordance with a sixth embodiment of the present invention.
Figure 17:
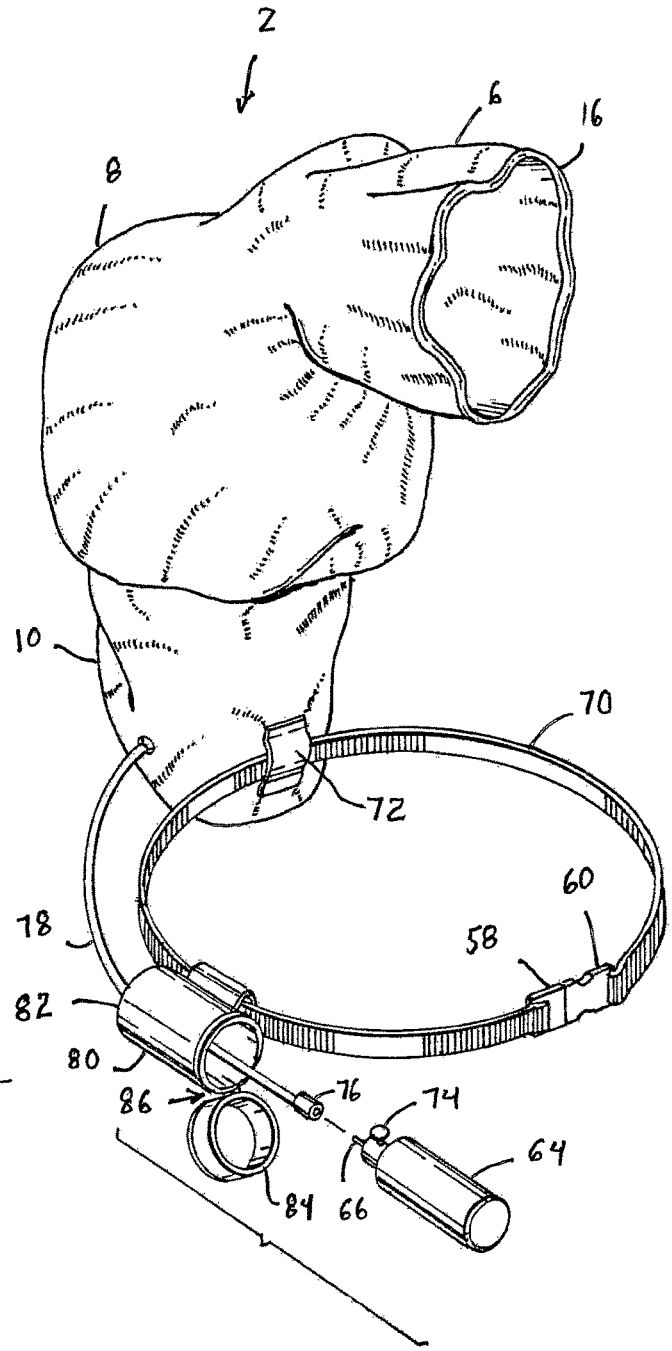
FIG. 17 is a perspective view of the swim cap shown in FIG. 16.

FIGS. 16 and 17 illustrate another form of an inflatable swim cap 2 constructed in accordance with the present invention. In this embodiment, the swim cap includes a belt 70 which may pass through a loop 72 attached to the outer layer 20 of the shell 4 of the swim cap at the third or end section 10 thereof. This belt 70 also preferably includes quick disconnect male and female connectors 58, 60 of a buckle at its axial ends to hold the third section 10 of the swim cap against the back of the wearer of the swim cap. Even more preferably, in this particular embodiment, a replaceable canister 64 filled with compressed air may be used to inflate the air chamber 26 within the outer and inner layers 20, 22 of the swim cap or the inner hair cavity 12. The canister 64 includes a valve 74, which may be opened and closed by the user to allow air from the compressed air canister 64 to escape through the needle end 66. The needle end 66 is received by a fitting 76 at one end of a filling tube 78 to allow air to flow through the filling tube 78 into the air chamber 26 or the inner hair cavity 12 of the swim cap. The other axial end of the filler tube 78 is connected to the swim cap and is in fluid communication with the air chamber 26 defined by the outer and inner layers 20, 22 thereof or the inner hair cavity 12.

Even more preferably, the compressed air canister 64 is contained within a cylindrical housing 80 mounted on the belt 70. The housing 80 has a closed axial end 82 with a small opening formed through the thickness thereof and which is dimensioned to closely receive the filler tube 78 passing therethrough and form a watertight seal therewith. The opposite axial end of the cylindrical housing 80 includes a removeable cap 84 affixed to the main portion of the housing by a living hinge 86. The cap 84 may be removed so that the user may gain access to the compressed air canister 64 to open the valve 74 and inflate the swim cap. Thus, the swim cap 2 illustrated by FIGS. 16 and 17 of the drawings provides another form of safety for the user of the swim cap by allowing the swim cap to be inflated with compressed air for additional buoyancy.

Figure 18:
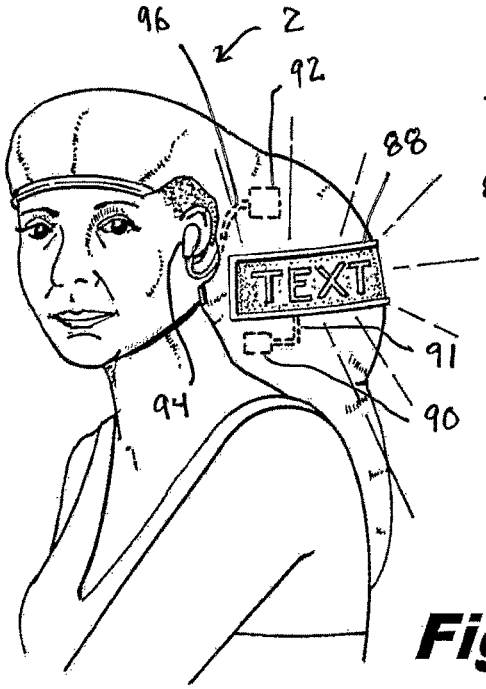
FIG. 18 is a perspective view of a swim cap formed in accordance with a seventh embodiment of the present invention and shown being worn by a user.

FIG. 18 illustrates another form of the swim cap 2 of the present invention. Here, the swim cap may include an illuminatable waterproof display 88 attached to the shell 4 thereof. Electronic circuitry 90, which preferably includes a microprocessor and battery, as would be well known to someone skilled in the art, is connected to the display by a cable 91 and is included to control the illumination of the display 88. The circuitry 90 may be affixed to the swim cap preferably within the inner cavity 12 defined by the shell 4, or may be mounted in a waterproof housing within the cavity 12, to protect the electronic circuitry from the environment. The electronic circuitry 90 allows the user to program the text or message displayed on the display 88. The display 88 may be used to identify the person wearing the swim cap, or may provide information to other people, such as the name of the person wearing the swim cap, or where to meet the person at a specific time. Additionally, and as shown in FIG. 18 of the drawings, the swim cap 2 of the present invention may include an electronic device 92, such as an iPOD™ player, which also may be housed within the cavity 12 of the shell 4 of the swim cap or in a protective, waterproof casing therein, and may be listened to by the user using an ear plug 94 connected by a cable 96 to the electronic device 92.

Figure 19:
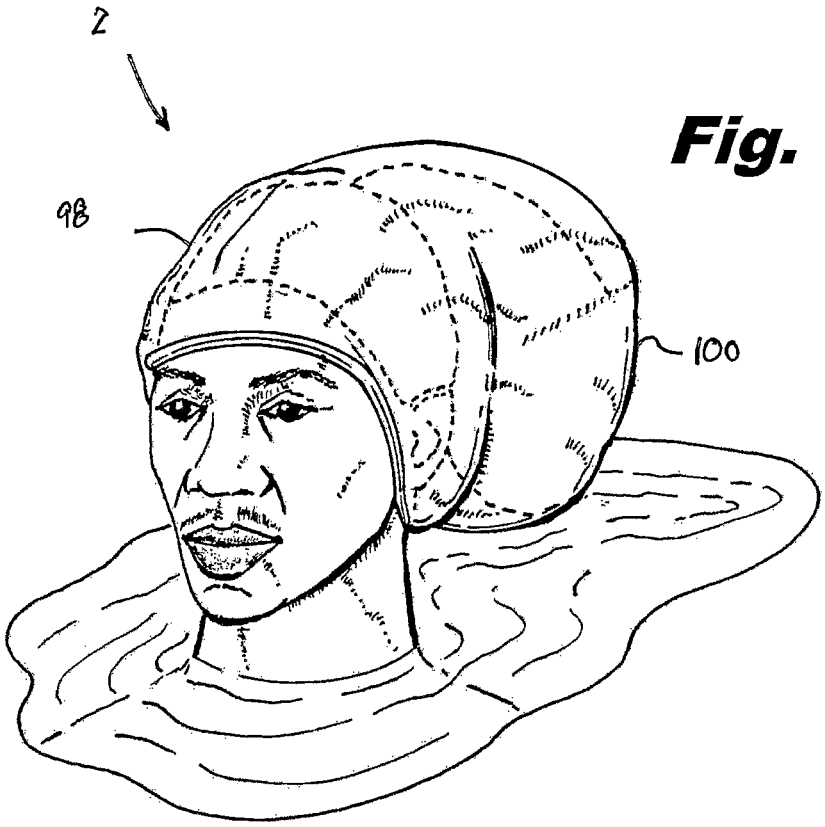
FIG. 19 is a perspective view of a swim cap formed in accordance with an eighth embodiment of the present invention.
Figure 20:
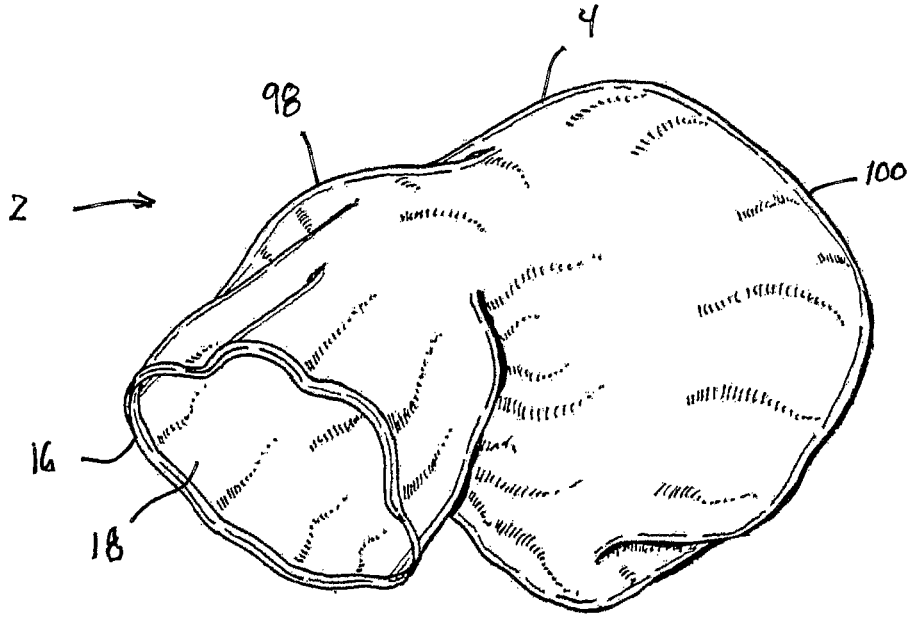
FIG. 20 is a front perspective view of the swim cap of the present invention shown in FIG. 19.
Figure 21:
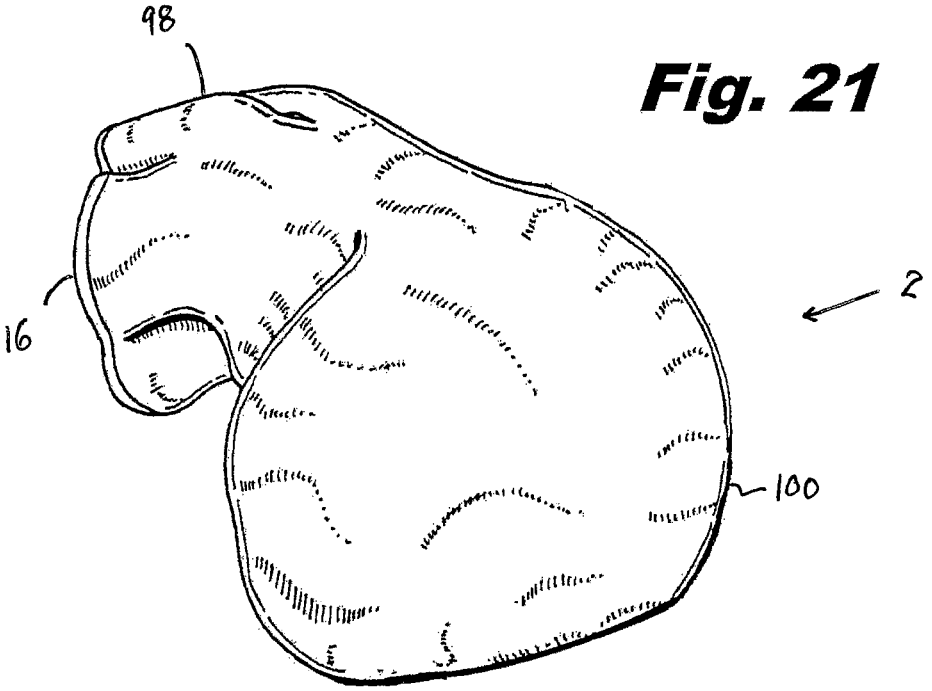
FIG. 21 is a rear perspective view of the swim cap of the present invention shown in FIGS. 19 and 20.
Figure 22:
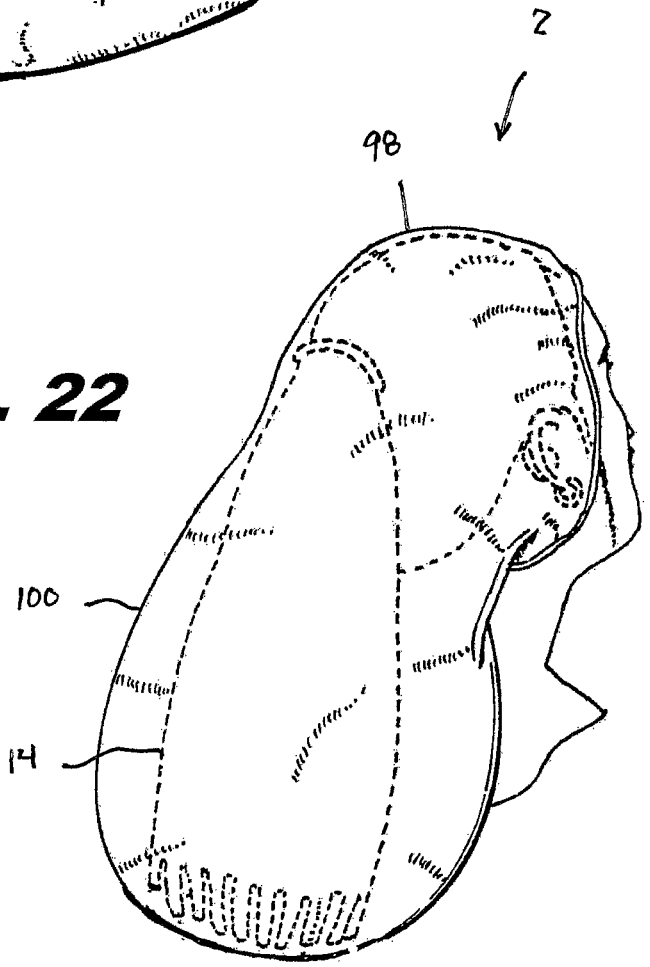
FIG. 22 is a rear perspective view of the swim cap of the present invention shown in FIGS. 19-21 and illustrating in broken lines the placement of a user's hair within the swim cap.

FIGS. 19-22 illustrate another form of the swim cap 2 of the present invention. The swim cap 2 shown in FIGS. 1-3 preferably includes three compartments or sections 6-10. In the embodiment shown in FIGS. 19-22, the swim cap 2 includes two interconnected compartments or sections—a first compartment or section 98 which is worn over the head of the user, as shown in FIG. 19, and a second, bulbous compartment or section 100 interconnected with the first section 98. This embodiment of the swim cap of the present invention is preferred for those users whose hair 14 is not so long as to require a three-section, contoured swim cap such as shown in FIGS. 1-3. As shown in FIG. 22, this embodiment of the swim cap 2 of the present invention provides sufficient space for a user having long hair or dreadlocks 14, but not so long as the hair of the user illustrated in FIGS. 4-6 of the drawings.

Figure 23:
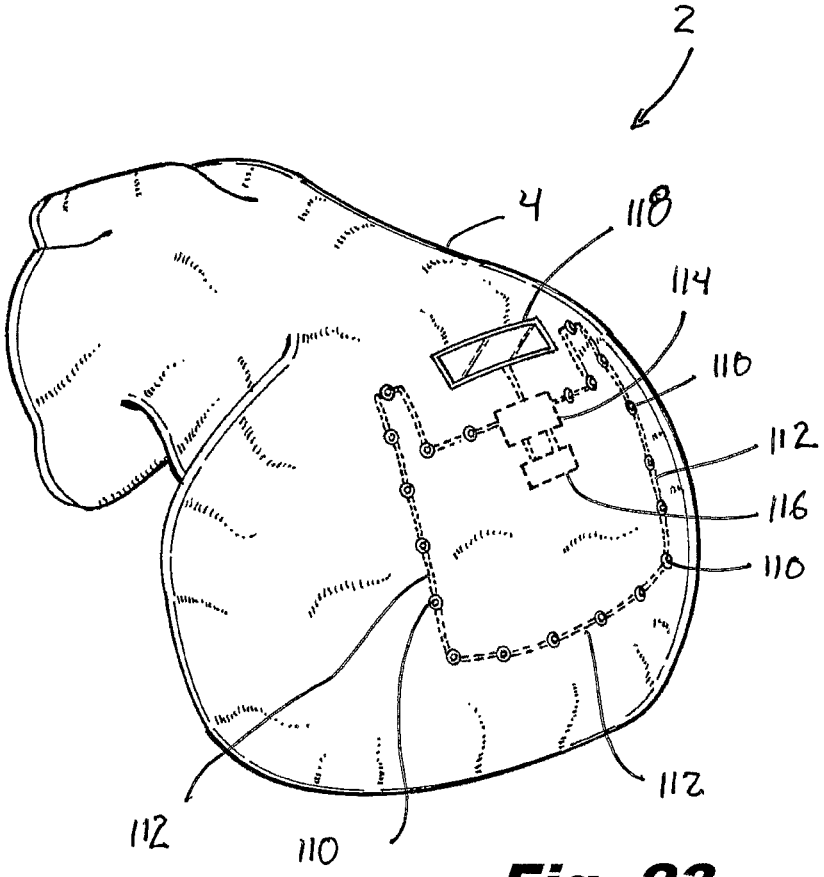
FIG. 23 is a rear perspective view of a swim cap formed in accordance with a ninth embodiment of the present invention.

FIG. 23 illustrates another form of a swim cap 2 constructed in accordance with the present invention. The swim cap 2 in this embodiment may include a plurality of interconnected light emitting devices (such as light emitting diodes) 110 mounted on the inside surface of the outer shell 4. The outer shell 4 may be translucent or transparent so that light emitted by the light emitting devices 110 may be seen from outside the swim cap 2. The light emitting devices 110 are interconnected by wires 112, and their illumination is controlled by an electronic circuit 114, such as a microcontroller, connected to the wires 112, which circuit 114 and light emitting devices 110 are powered by a battery 116. Alternatively, or in conjunction with the battery 116, a waterproof solar cell 118 may be mounted on the outer surface of the shell 4 either to power the electronic circuit 114 or light emitting devices 110 directly or indirectly or to recharge the battery 116. The electronic circuit 114, battery 116 and wires 112 are also mounted on the inside surface of the shell 4. The circuit 114 and battery 116 may be encased in a waterproof flexible pouch (not shown) mounted on the inside surface of the outer shell 4 of the cap, or may be mounted within the confines of the air chamber 26 defined by the outer layer 20 and the inner layer 22 of the shell 4, such as included in the inflatable version of the swim cap 2 shown in FIGS. 7-9 of the drawings. The light emitting devices 110 may be caused by the electronic circuit 114 to illuminate in a steady or pulsating fashion, and in the same or different colors.

Figure 24A:
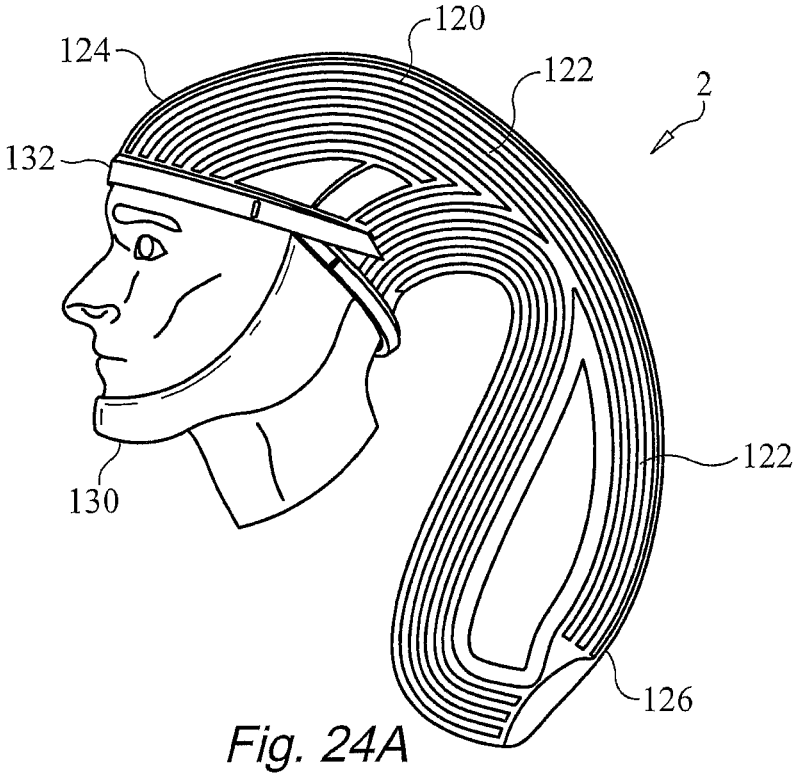
FIGS. 24A and 24B are perspective views showing another form of the swim cap of the present invention, FIG. 24A showing the swim cap with a chin strap, and FIG. 24B showing the swim cap with ear flaps.
Figure 24B:
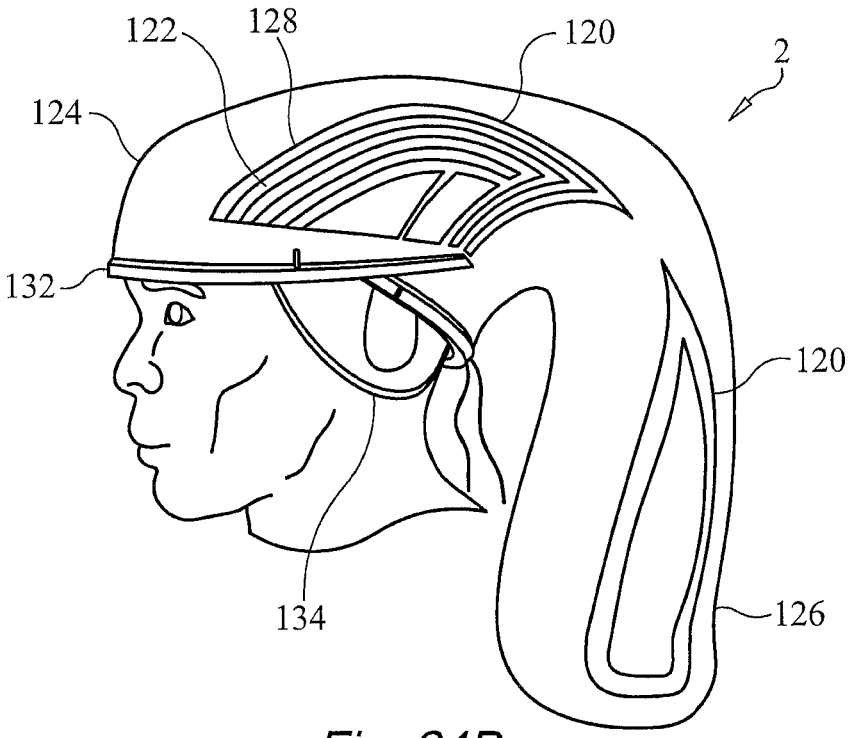

Another form of the swim cap 2 of the present invention is shown in FIGS. 24A and 24B of the drawings. Here, the swim cap 2 includes an ornamental design 120 on its exterior surface, which design includes a series of raised, generally parallelly disposed ribs or ribbing 122 that extend along the longitudinal length of the swim cap 2 from the front section 124 thereof to the rear section 126 thereof. Alternatively, the swim cap 2 may include other ornamental designs 120 formed on its exterior surface, such as a series of raised, parallelly disposed ribs or ribbing 122 generally defining the outline of a fin 128 on the lateral sides of the swim cap 2. Also, as illustrated in FIG. 24A, the swim cap 2 may include a chin strap 130 attached to and extending from the front edge 132 of the swim cap 2 on each lateral side thereof and about the chin of the wearer to hold the swim cap 2 in place on the wearer's head. Alternatively, and as shown in FIG. 24B, the swim cap 2 may include a pair of ear flaps or ear covers 134 that extend from opposite lateral sides of the front edge 132 of the swim cap 2, which ear flaps 134 at least partially cover the ears of the wearer of the swim cap 2.

Figure 25A:
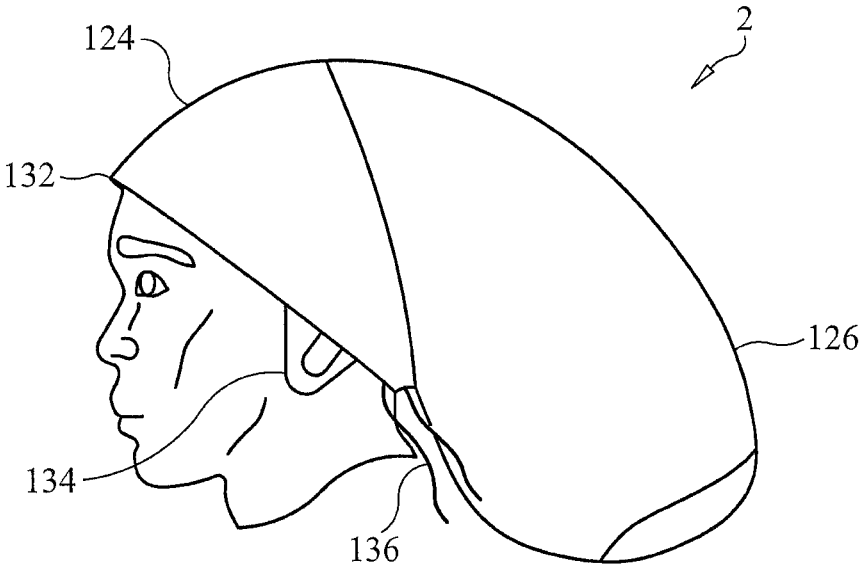
FIGS. 25A and 25B are perspective views showing another form of the swim cap of the present invention, and illustrating the swim cap with a draw string to hold the swim cap on the forehead of a person wearing the swim cap.
Figure 25B:
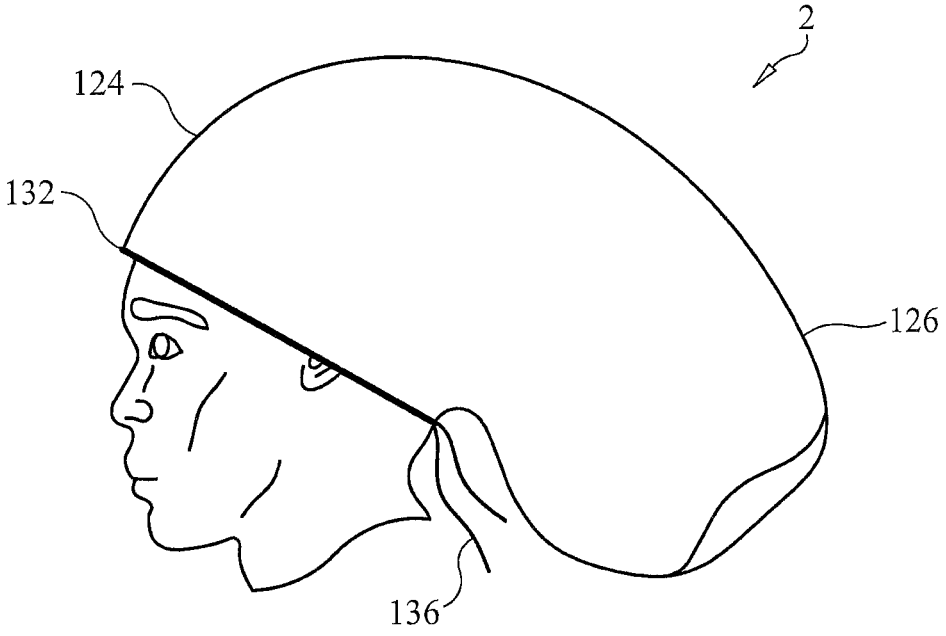
Figure 28:
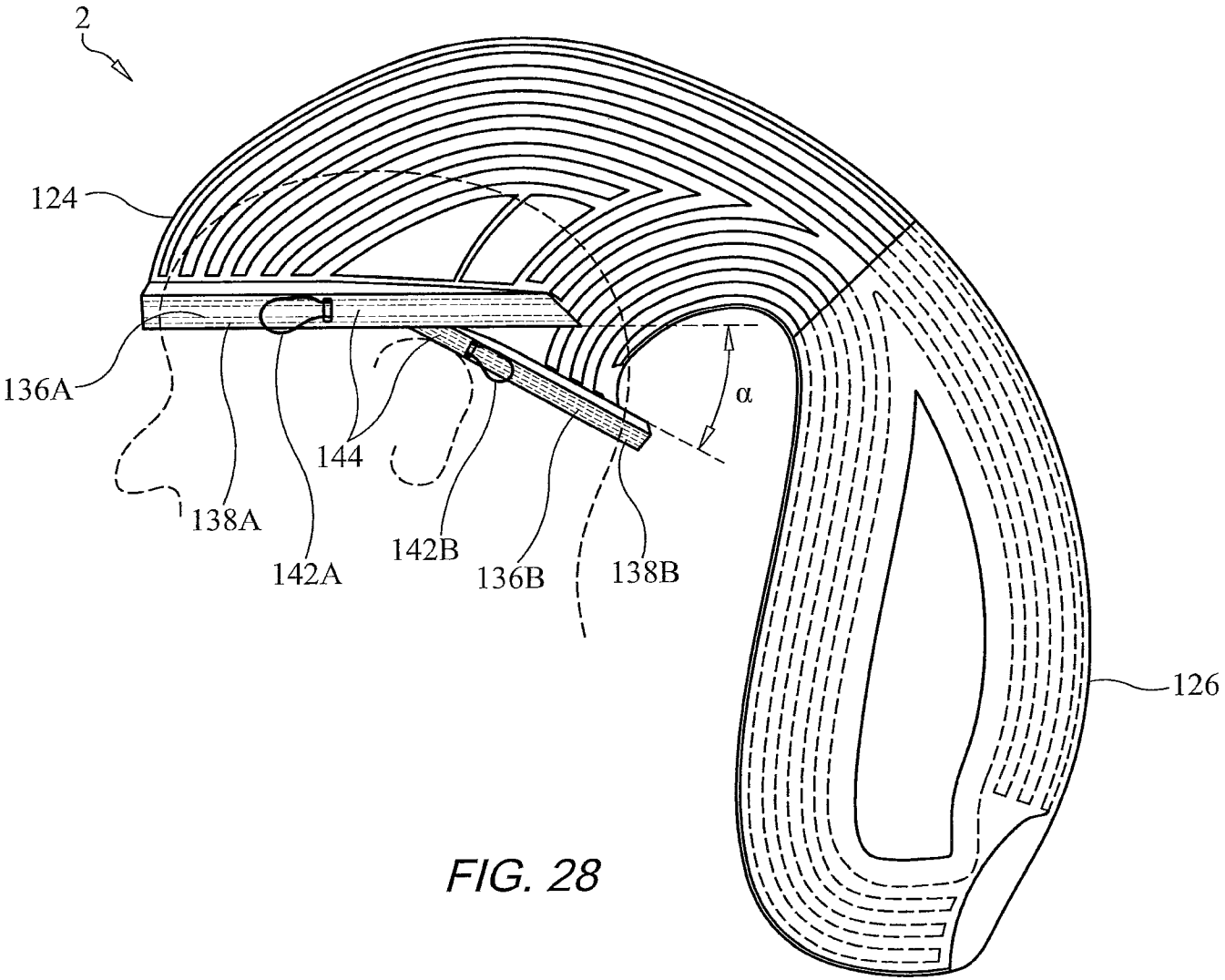
FIG. 28 is an enlarged side view of the swim cap shown in FIG. 27D and illustrating the channels and draw cords received by the channels for tightening the swim cap on the wearer's head.
Figure 29A:
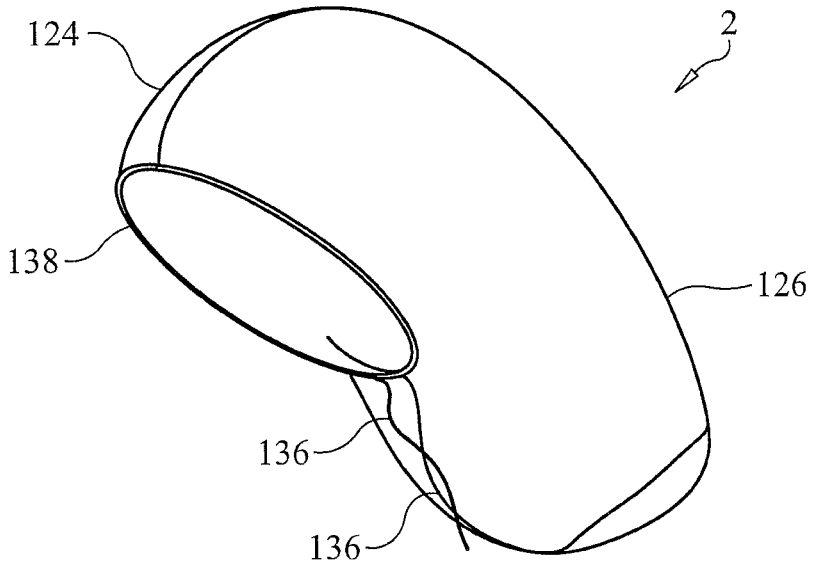
FIGS. 29A-D are respectively a perspective view, a front view, a top view and a side view (also showing the outline of a person's head) of another form of the swim cap of the present invention, and illustrating the features of the swim cap shown in FIG. 25B and, in particular, a draw cord for adjustably securing the swim cap to the wearer's head.
Figure 29B:
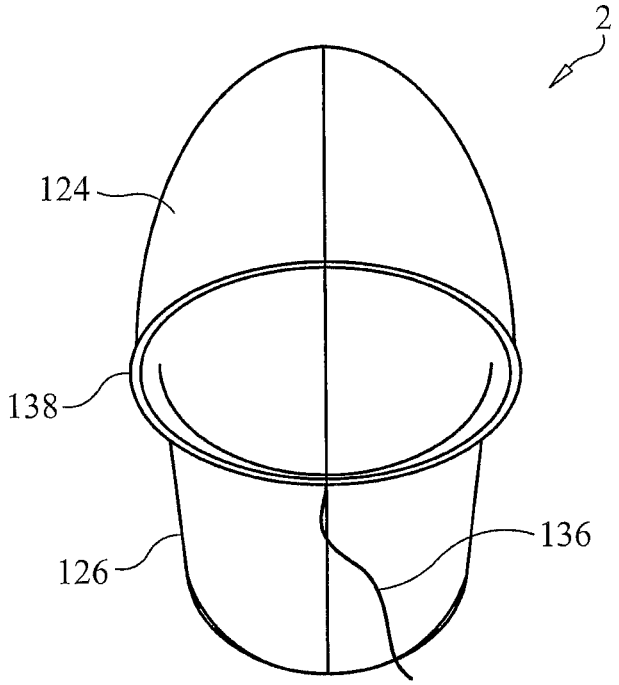
Figure 29C:
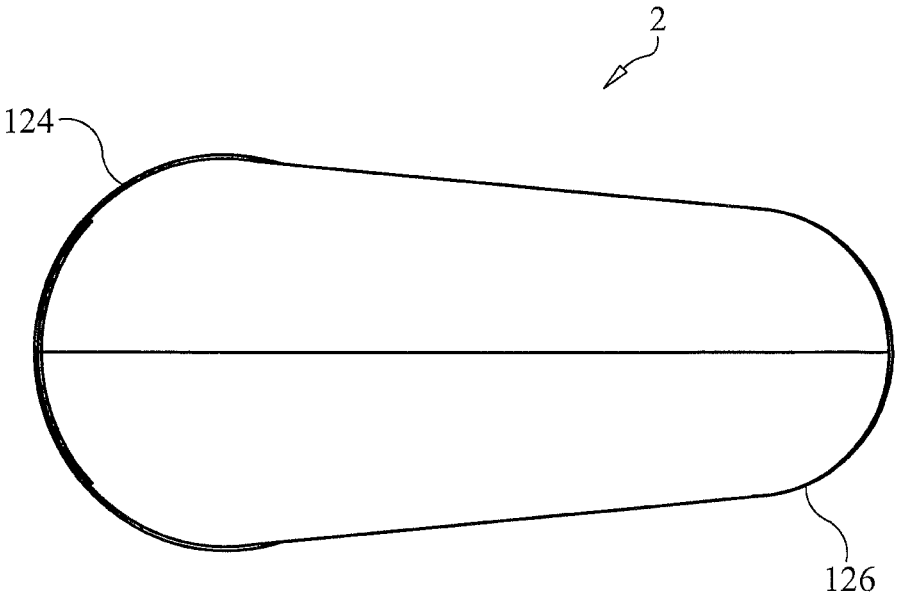
Figure 29D:
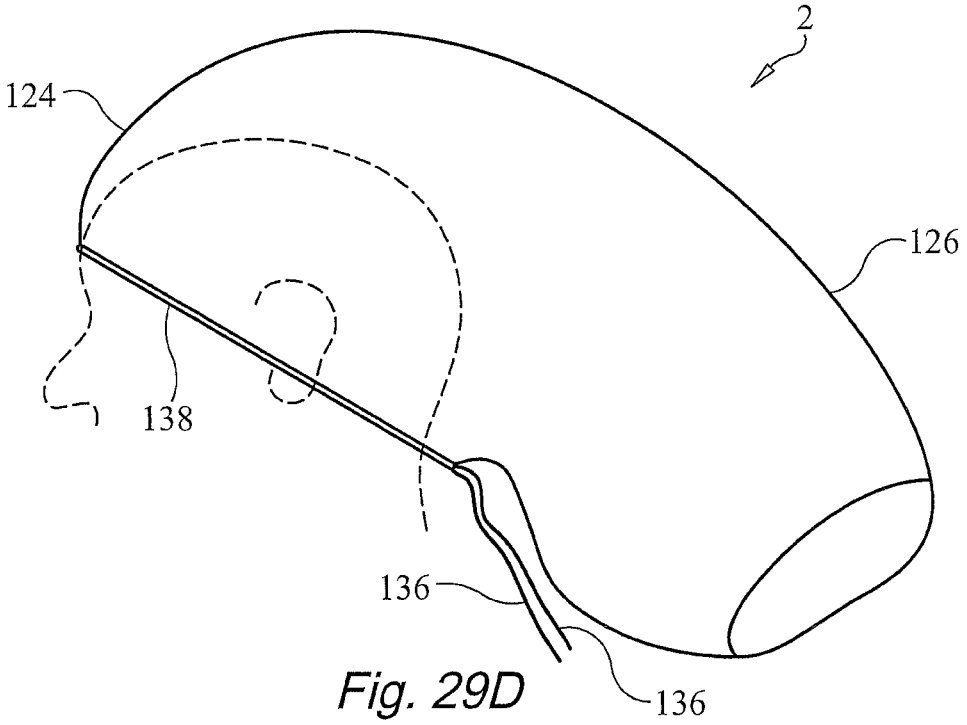

FIGS. 25A and 25B illustrate another form of the swim cap 2 of the present invention, where the swim cap 2 also includes ear flaps, or ear covers 134, such as described previously, but also a draw string 136, whose free ends extend from openings formed in the front edge 132 of the swim cap 2 at the rear surface thereof (behind the wearer's head). The draw string 136 is passed through a channel 138 (see FIGS. 28 and 29D) formed about the periphery on the interior surface or exterior surface of the swim cap 2 at the front portion 124 thereof, so that a user may pull on the free ends of the draw string 136 to adjustably tighten the swim cap 2 on the head of the wearer in order to secure the swim cap 2 in place on the wearer's head and to minimize any water from entering the interior of the swim cap 2.

More specifically, the swim cap 2 of the present invention may have a single concentric band or draw cord 136 that extends in a channel 138 about the front periphery 132 of the swim cap 2 for securing the swim cap 2 on the wearer's head. The swim cap 2 also includes ear covers or flaps 134 formed on the lateral sides of the swim cap 2 that extend below the front peripheral edge 132 of the swim cap 2 to at least partially cover the wearer's ears and to minimize any water entering the wearer's ears. Alternatively, and as shown in FIG. 25B, the peripheral edge 132 of the swim cap 2 may extend at least partially over the wearer's ears, again to minimize any water entering the ears of the wearer.

Figure 26:
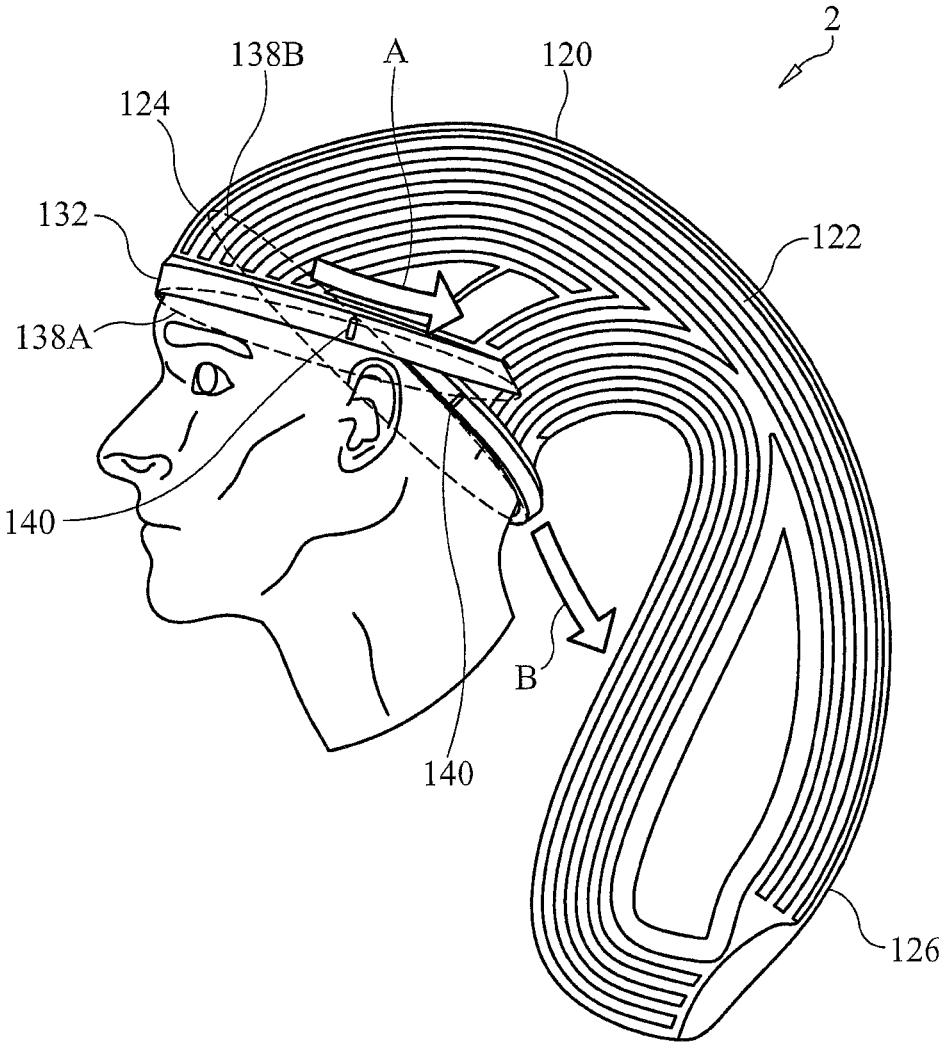
FIG. 26 is a perspective view showing another form of the swim cap of the present invention, and illustrating pull tabs which are used to adjust the position of the swim cap on the wearer's head and to secure the swim cap to the wearer's head.

FIG. 26 illustrates another form of the swim cap 2 of the present invention, with ornamental designs 120 in the form of raised ribs or ribbing 122 formed on the exterior surface of the swim cap 2, such as shown in FIGS. 24A and 24B, and also with two adjustable bands or draw cords 136A, 136B for securing the swim cap 2 to the wearer's head. Like the draw string 136 in the embodiment of the swim cap shown in FIGS. 25A and 25B, the bands or draw cords 136 in the embodiment shown in FIG. 26 are received in respective channels 138A, 138B formed in the exterior surface or interior surface of the swim cap 2 that extend about the circumference of the forward or front portion 124 of the swim cap 2. The adjustable bands or draw cords 136A, 136B and their respective receiving channels 138A, 138B are disposed at different angles on the swim cap 2 with respect to each other, as shown in FIG. 26. The arrangement of the bands 136A, 136B and channels 138A, 138B is also shown in FIGS. 27A-D and FIG. 28.

Referring now to FIGS. 27A-D and FIG. 28, it may be realized that there are at least first and second bands or draw cords 136A, 136B which are received in respective channels 138A, 138B formed in the swim cap 2. Each of the first and second bands 136A, 136B may be continuous, flattened circular pieces. Loops of the continuous bands or draw cords 136A, 136B may extend out of openings 140 formed in the respective channels 138A, 138B in which the bands or draw cords 136A, 136B are received, the openings 140 being situated on opposite lateral sides of the swim cap 2. The loops may be attached to respective pull tabs 142A, 142B which may be pulled by the user outwardly of the openings 140 (see the arrows A and B in FIG. 26) to tighten the bands 136A, 136B about the wearer's head at two different angles.

Alternatively, each band or draw cord 136A, 138B need not be a continuous loop, but rather may be in the form of an elongated member which encircles the wearer's head at least once around (i.e., 360°) and another half-circle (i.e., approximately 180°) so that the free ends of the bands or draw cords 136A, 136B extend out the openings 140 of the channels 138A, 138B receiving the bands or draw cords 136A, 136B formed in the swim cap 2 on opposite lateral sides thereof.

In yet another form of the swim cap, the first and second bands or draw cords 136A, 136B, and their respective channels 138A, 138B, may only extend partially about the circumference of the swim cap head opening to only partially encircle the wearer's head. More specifically, each of the first and second bands or draw cords 136A, 136B may be defined by separate first and second sections 144, each section 144 being movably disposed in a respective section receiving channel 138A, 138B formed on the exterior surface or interior surface of the swim cap 2 and extending over portions of the lateral sides thereof. Stated another way, a portion of the draw cord 136A or 136B on one lateral side of the swim cap 2 need not be joined to the portion of the same draw cord 136A or 136B located on the other lateral side of the swim cap 2. One free end of each of the first and second sections 144 of each of the angularly offset bands or draw cords 136A, 136B may extend out an opening or slot 140 formed in a respective section receiving channel 138A, 138B so that it may be grasped by the wearer of the swim cap 2. The other end axially opposite the free end of each of the first and second sections 144 of each of the angularly offset bands or draw cords 136A, 136B may be affixed to the interior surface or exterior surface of the swim cap 2 so that, when the wearer of the swim cap 2 pulls on the free ends of the band or draw cord sections 144, he or she will reduce the overall size of the head opening of the swim cap 2 to not only adjust the position of the swim cap 2 on the wearer's head but also tighten the swim cap 2 on the wearer's head to minimize or prevent any water from seeping into the interior of the swim cap 2.

The free ends of each band or draw cord 136A, 136B which extend out the openings 140 of the respective channels 138A, 138B in which they slideably move may be affixed to pull tabs 142A, 142B which, as mentioned previously, facilitate a user grasping the ends of the bands or cords 136A, 136B to adjust and tighten the swim cap 2 on the wearer's head. A user will pull on the tabs 142A, 142B of each band or draw cord 136A, 136B to adjust not only the position of the swim cap 2 on the wearer's head, for a tight but comfortable fit, but also to help minimize the inflow of any water into the interior of the swim cap 2 when worn by the user.

It may be seen from FIGS. 27A-D and FIG. 28 that the first and second bands or draw cords 136A, 136B are angularly offset from and cross each other, and are disposed at different angles on the swim cap 2. More specifically, the first band or draw cord 136A defines an interior angle $\alpha$ with the second band or draw cord 136B at the rear side of the front portion 124 of the swim cap 2 of about 30° (see FIGS. 27D and 28). The first, more forward band or draw cord 136A tightens the front peripheral edge 132 of the swim cap 2 about the wearer's forehead. The second, less forwardly-disposed band or draw cord 136B is angled higher on the user's head, approximately near his hair line, and lower on the wearer's neck, than the first band or draw cord 136A. By having at least two adjustable bands or draw cords 136A, 136B, angularly offset from each other, a more secure attachment to the wearer's head, with greater water tightness, may be achieved than with a swim cap having a single tightening band or draw cord 136 or than with a swim cap having no tightening band or draw cord 136.

Figure 27A:
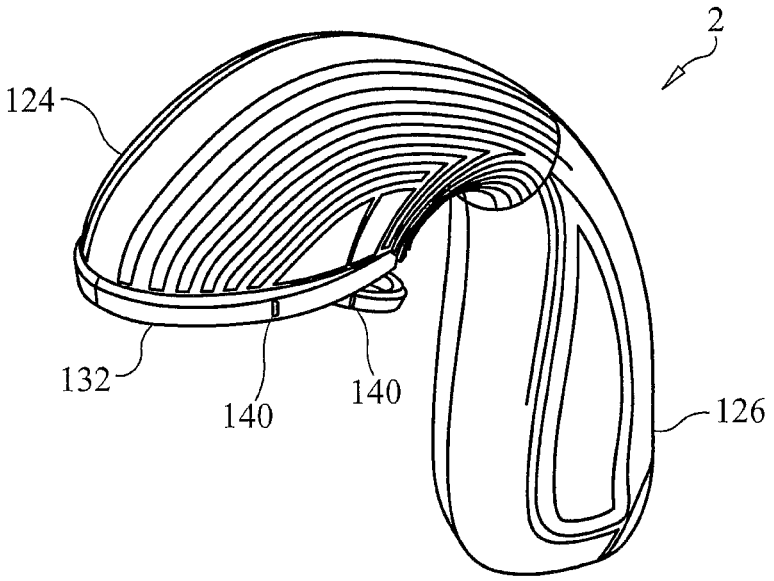
FIGS. 27A-D are respectively a perspective view, a front view, a top view and a side view (also showing the outline of a person head) of another form of the swim cap of the present invention, and illustrating in FIG. 27C a water resistant seam zipper attached thereto, and illustrating in FIGS. 27A, 27B and 27D a pair of draw cords and pull tabs for adjusting the swim cap on the wearer's head and for securing the swim cap to the wearer's head.
Figure 27B:
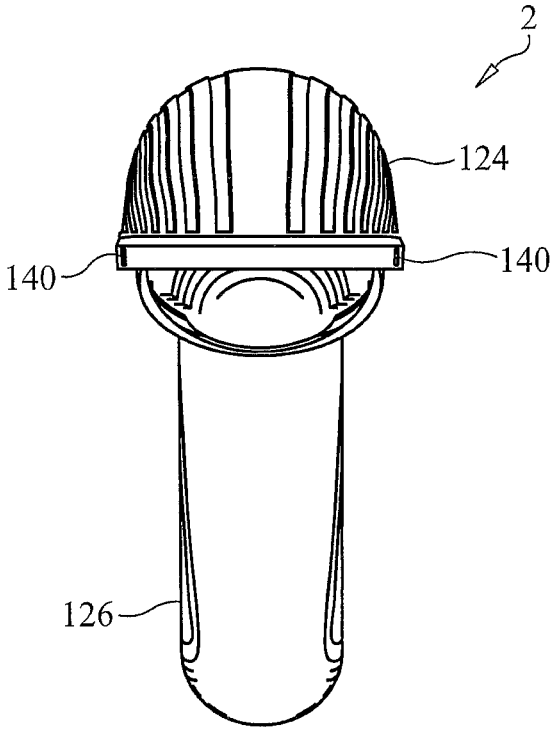
Figure 27C:
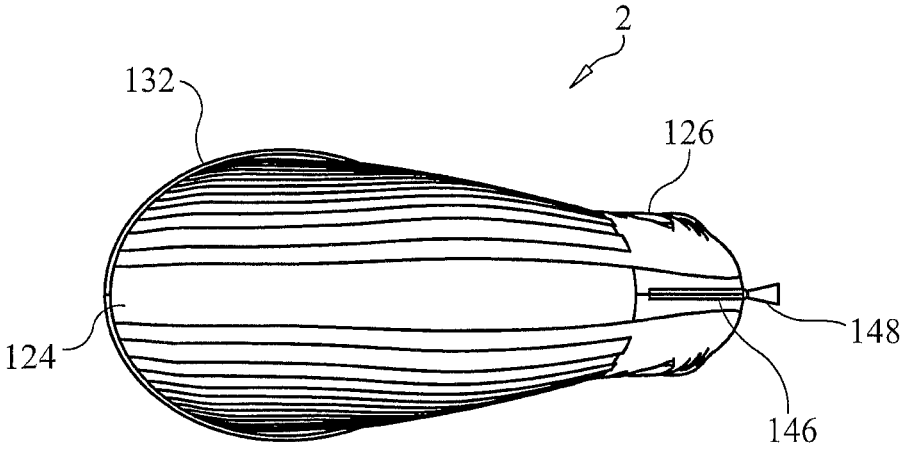
Figure 27D:
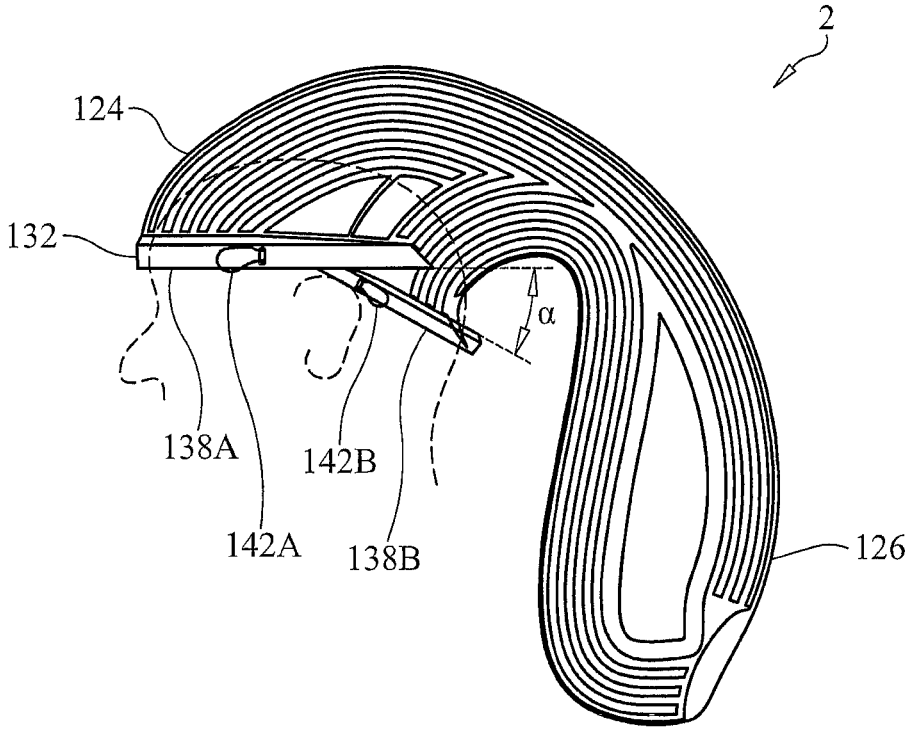

As further shown in FIG. 27C, the swim cap 2 may include a slot, cut or separation 146 formed in the shell 4 of the swim cap 2 and situated in the rear compartment or section 10 thereof, and a water resistant zipper 148 extending along the length of the slot or cut 146. The slot or cut 146, and zipper 148, are preferably positioned on the top side of the rear portion 126 of the swim cap 2, as shown in FIG. 27C, so that a user may gain access through the slot or cut 146 to the interior of the swim cap 2 at the rear portion 126 thereof to adjust the position of his or her hair extending into the rear compartment or section 10 of the swim cap 2. The water resistant zipper 148 engages the edges of the slot or cut 146 and extends along the longitudinal length thereof, and may be positioned in a first, open position, where the slot or cut 146 is open, and in a second, closed position, where the zipper 148 closes and water tightly seals the slot or cut 146 formed in the swim cap 2. The zipper 148 is water resistant so as to help minimize or prevent the inflow of water through the slot or cut 146 and into the interior of the swim cap 2.

FIGS. 29A-29D illustrates another form of the swim cap 2 of the present invention, similar to that shown in FIG. 25B, where a nylon draw cord 136 surrounding the front peripheral edge 132 of the swim cap 2 is shown for adjustably securing the swim cap 2 to the wearer's head, and further illustrating that the swim cap 2 may at least partially cover the wearer's ears to prevent or minimize water from entering the wearer's ears.

Figure 30:
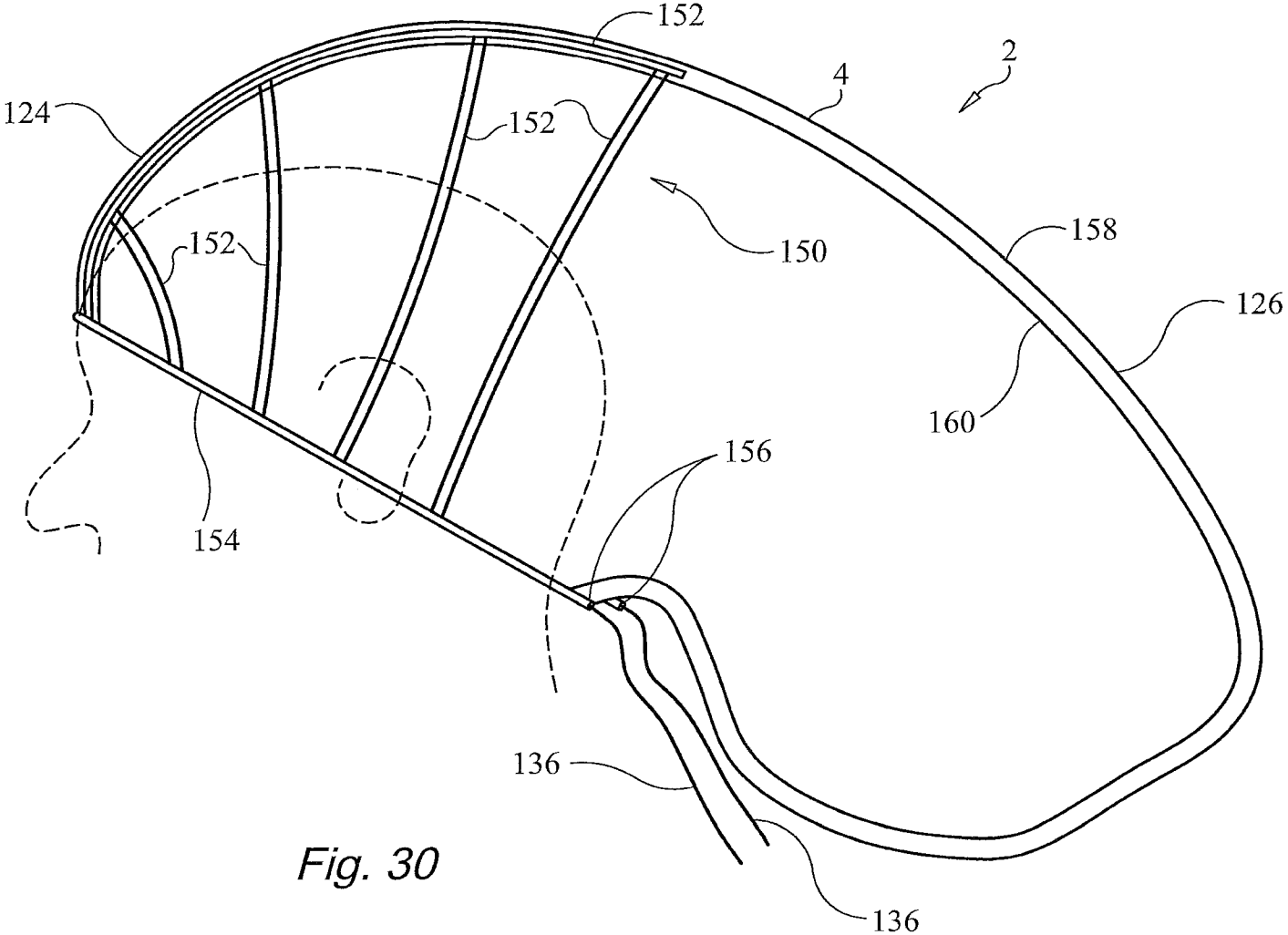
FIG. 30 is a longitudinal, semi-cross-sectional view showing yet another form of the swim cap of the present invention, and illustrating the swim cap being constructed with a framework of flexible ribs.

Another form of the swim cap 2 of the present invention is shown in FIG. 30. In this version, the swim cap 2 is formed from a framework 150 of multiple, flattened, flexible ribs 152 which are spaced apart from each other and bent to define the framework 150 with a concave shape so that the ribs 152, and the framework 150 defined thereby, may be fitted onto the head of a person wearing the swim cap 2. The ribs 152 may extend in a lateral direction and in a front-to-back direction so that they crisscross each other. The framework 150 also includes a flexible conduit 154 bent in a circular or oval shape to define an interior area. The ends of the ribs 152 are affixed to the flexible conduit 154, which is positioned at, and defines, the open end of the swim cap 2 through which a user's head is received. The flexible conduit 154 may extend substantially completely around the open end of the swim cap 2, or more preferably, extends only partially around the open end so that the open axial ends 156 of the flexible conduit 154 terminate from about 180 degrees to about 270 degrees in a circle or oblong shape such that the axial ends 156 preferably extend behind the ears of a person wearing the swim cap 2.

A draw cord or string 136 is received in the bore of the flexible conduit 154, and the opposite axial ends of the draw cord 136 extend out the open axial ends 156 of the flexible conduit 154. In this way, a person may grasp the ends of the draw cord 136 to adjust the interior area defined by the flexible conduit 154 in order to loosen or tighten the flexible conduit 154 about the head of the person wearing the swim cap 2.

A shell or covering 4, made from a waterproof or water resistant material, encapsulates the framework 150 of ribs 152 and flexible conduit 154. More specifically, the covering 4 includes an outer layer 158, which covers the outside surfaces of the framework 150, with its flexible ribs 152 and flexible conduit 154, and an inner layer 160, which covers the opposite inside surfaces of the framework 150 of flexible ribs 152 and flexible conduit 154. With this particular version of the swim cap 2, the framework 150 of ribs 152 provides support for the covering 4 of the swim cap 2 to prevent or minimize the covering 4 from collapsing. In other words, the framework 150 adds stiffness to the swim cap 2 so that the swim cap 2 will retain its shape at least over portions thereof that are supported by the framework 150. The flexible conduit 154, situated at the open end of the swim cap 2, may be tightened about a wearer's head by the wearer pulling on the draw string 136 situated within the bore of the conduit 154 and extending outwardly from the open axial ends 156 thereof.

The swim cap 2 of the present invention is perfectly adapted for use by a person with dreadlocks or long hair. The user's hair is received through the front, open end of the swim cap 2 and extends into the interconnecting rear compartment or section 10 of the swim cap 2.

The shell 4 of the swim cap 2 may be blow molded, and may be formed from LIM TPE (Thermoplastic Elastomer), such as Silicone, having a durometer range of about 35 to about 65 Shore A. The swim cap 2 may come in a variety of sizes, such as small, medium and large cap sizes, and in a variety of colors, including black, blue, green yellow and red, and combinations thereof, or in fluorescent colors so as to be more noticeable. The material of the draw cord or band 136 is preferably Nylon, and the pull tabs 142 and zipper 148 and its draw clasp may be formed from polyethylene or polypropylene.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A swim cap configured for use by a person with long hair, which comprises:

an outer shell, the shell having an open end and a closed end situated opposite the open end, the open end being sized to fit on the head of a person, the outer shell being formed from a waterproof material, the outer shell including an outer layer and an inner layer, the outer layer and the inner layer defining an airtight chamber;

at least one compartment within the shell, the at least one compartment defining an elongated hair-receiving cavity for receiving the hair of the person wearing the swim cap; and adjustable means configured for securing the shell to the head of the person wearing the swim cap;

wherein the swim cap further comprises:

at least one light emitting device, the at least one light emitting device being selectively illuminatable and emitting light, the light emitted by the light emitting device being viewable outside the shell of the swim cap; and an electronic circuit, the electronic circuit being electrically coupled to the at least one light emitting device to cause the at least one light emitting device to selectively illuminate, the electronic circuit being mounted within the airtight chamber defined by the outer layer and the inner layer of the outer shell.

2. A swim cap as defined by claim 1, wherein the electronic circuit includes a microcontroller, the microcontroller being electronically coupled to the at least one light emitting device to cause the at least one light emitting device to be selectively illuminatable.

3. A swim cap as defined by claim 1, wherein the electronic circuit includes a battery, the battery providing power to the electronic circuit.

4. A swim cap as defined by claim 1, wherein the swim cap includes a solar cell.

5. A swim cap as defined by claim 4, wherein the solar cell is waterproof and is mounted on the outer shell of the swim cap.

6. A swim cap as defined by claim 1, wherein the electronic circuit causes the at least one light emitting device to illuminate in one of a steady fashion and a pulsating fashion.

7. A swim cap as defined by claim 1, wherein the at least one light emitting device includes a plurality of light emitting devices, the light emitting devices of the plurality of light emitting devices illuminating in one of the same color and different colors.

8. A swim cap as defined by claim 1, wherein the at least one light emitting device includes an illuminatable display.

9. A swim cap as defined by claim 8, wherein the electronic circuit causes the display to display a text or message.

10. A swim cap as defined by claim 9, wherein the electronic circuit causes the display to display a message identifying the person wearing the swim cap.

11. A swim cap as defined by claim 1, wherein at least a portion of the shell is transparent or translucent; and wherein the at least one light emitting device is situated within the elongated hair-receiving cavity defined by the at least one compartment, the light emitted by the at least one light emitting device being viewable through the transparent or translucent portion of the shell of the swim cap.

* * * * *